US007178637B2

(12) United States Patent
Asano et al.

(10) Patent No.: US 7,178,637 B2
(45) Date of Patent: Feb. 20, 2007

(54) BOTH-WAY MOVABLE BODY DRIVING MECHANISM AND ELEVATOR USING THE SAME

(75) Inventors: Takashi Asano, Ibaraki (JP); Yosuke Goda, Ibaraki (JP); Kenichi Yamamoto, Ibaraki (JP); Mamoru Harada, Ibaraki (JP)

(73) Assignee: Fujitec Co., Ltd., Ibaraki (JP)

( * ) Notice: Subject to any disclaimer, the term of this patent is extended or adjusted under 35 U.S.C. 154(b) by 462 days.

(21) Appl. No.: 10/467,161

(22) PCT Filed: Feb. 14, 2002

(86) PCT No.: PCT/JP02/01220

§ 371 (c)(1),
(2), (4) Date: Aug. 12, 2003

(87) PCT Pub. No.: WO02/064482

PCT Pub. Date: Aug. 22, 2002

(65) Prior Publication Data

US 2004/0050627 A1 Mar. 18, 2004

(30) Foreign Application Priority Data

Feb. 16, 2001 (JP) ..... 2001-039609
Jul. 24, 2001 (JP) ..... 2001-223374

(51) Int. Cl.
*B66B 11/08* (2006.01)

(52) U.S. Cl. ..... 187/254; 187/252; 187/264; 187/250; 254/333

(58) Field of Classification Search ..... 187/250, 187/254, 255, 264; 254/333
See application file for complete search history.

(56) References Cited

U.S. PATENT DOCUMENTS 3,878,916 A * 4/1975 White, Jr. ..... 182/145

(Continued)

FOREIGN PATENT DOCUMENTS

DE 614 477 6/1935

(Continued)

*Primary Examiner*—Kathy Matecki
*Assistant Examiner*—Terrell Matthews
(74) *Attorney, Agent, or Firm*—Armstrong, Kratz, Quintos, Hanson & Brooks, LLP

(57) ABSTRACT

The invention provides an elevator apparatus comprising a cage 1 disposed inside a path of upward or downward movement vertically movably, a counterweight 2 vertically movable with the upward or downward movement of the cage 1, and a lift drive mechanism for driving the cage 1 upward or downward. The drive mechanism comprises a sheave 42 disposed inside the path, ropes 3 extending along a route around the sheave 42, and a drive device 5 in engagement with the ropes 3. The drive device 5 comprises a belt transmission provided alongside the ropes 3 and revolvingly movable along the rope extension route, a mechanism for pressing a belt surface of the belt transmission into contact with the ropes 3, and a drive motor for driving the belt transmission. The cage can be driven upward or downward without using any traction sheave, while the cage can be reduced in weight.

10 Claims, 21 Drawing Sheets

U.S. PATENT DOCUMENTS

| | | | | |
|---|---|---|---|---|
| 4,620,615 | A * | 11/1986 | Morris et al. | 187/264 |
| 5,921,352 | A | 7/1999 | Garrido et al. | |
| 6,138,799 | A * | 10/2000 | Schroder-Brumloop et al. | 187/252 |
| 6,742,627 | B2 * | 6/2004 | Drabot et al. | 187/254 |
| 2002/0056593 | A1 * | 5/2002 | Adifon et al. | 187/254 |
| 2003/0057031 | A1 * | 3/2003 | Gottlieb et al. | 187/394 |

FOREIGN PATENT DOCUMENTS

| | | |
|---|---|---|
| JP | 55-180683 | 6/1954 |
| JP | 52-4814 | 2/1977 |
| JP | 79050/1979 | 12/1980 |
| JP | 62-14078 | 4/1987 |
| JP | 1-10294 | 3/1989 |
| JP | 2-1075 | 1/1990 |
| JP | 6-36052 | 9/1994 |
| WO | WO 99/43592 | 9/1999 |
| WO | WO 99/43592 A1 | 9/1999 |
| WO | WO 9943592 A1 * | 9/1999 |

* cited by examiner

BOTH-WAY MOVABLE BODY DRIVING MECHANISM AND ELEVATOR USING THE SAME

TECHNICAL FIELD

The present invention relates to a mechanism for reciprocatingly driving a reciprocatingly movable body, and elevator apparatus comprising a mechanism for reciprocatingly driving a cage which is reciprocatingly movably disposed in a path of reciprocating movement.

BACKGROUND ART

For use in such elevator apparatus, a lift drive mechanism is already known which comprises, as shown in FIG. 24, a plurality of ropes 3 reeved around a plurality of sheaves, such as a traction sheave 9 rotatingly driven by a drive motor 91 and direction changing sheaves 4, 43 attached to a cage 1 and a counterweight 2, and having fixed opposite ends 31, 32 for moving the cage 1 and the counterweight 2 upward or downward in opposite directions to each other.

With the elevator apparatus described, the cage 1, counterweight 2 and lift drive mechanism described are arranged in a lift path 10, the cage 1 is guided by guide rails 14, 14 for upward or downward movement, and the counterweight 2 is guided by guide rails 15, 15 for upward or downward movement as shown in FIG. 25. The drive motor 91 has connected thereto an unillustrated control circuit for controlling the upward and downward movement of the cage 1 and stopping of a cage door 11 at a position coinciding with a floor door 12.

With the conventional elevator apparatus shown in FIGS. 24 and 25, the rope 3 reeved around the traction sheave 9 must move with the rotation of the sheave 9 without slipping relative to the sheave 9 while the traction sheave 9 is being rotated by the drive motor 91 to move the cage 1 upward or downward. For this reason, the prior art has encountered problems such as difficulty in reducing the weight of the cage 1.

To render the rope 3 of the conventional elevator apparatus reeved around the traction sheave 9 free of slipping in the case where the rope 3 is subjected to tension T1 on the slack side thereof and to tension T2 on the tensioned side thereof as shown in FIG. 26, the relationship of Mathematical Expression 1 (Eytelwein) needs to be satisfied, assuming that the coefficient of friction between the traction sheave 9 and the rope 3 is μ and that the angle of the rope 3 reeved around the sheave 9 is θ.

(Mathematical Expression 1)

$$T2/T1 \leqq \exp(\mu \cdot \theta)$$

Suppose the tension T1 on the slack side is due to the weight of the cage 1. When a small number of passengers are in the cage 1, the tension T1 is small, and the rope 3 is likely to slip, failing to satisfy the relationship of Mathematical Expression 1. For example, suppose the cage 1 itself has weight of 1500 Kg, the loading capacity of the cage is 1000 Kg, and the weight of the counterweight 2 is the weight of the cage 1 plus 50% of the loading capacity. The left side member of Expression 1 has the following values when the weight of load is zero and when the cage is fully loaded.

(Mathematical Expressions 2)

$$T2/T1=2000/1500=1.33$$

$$T2/T1=2500/2000=1.25$$

If the weight of the cage 1 itself is then reduced to 1000 Kg, the values of Mathematical Expressions 2 are as follows.

(Mathematical Expressions 3)

$$T2/T1=1500/1000=1.5$$

$$T2/T1=2000/1500=1.33$$

Thus, a change in the weight of the cage itself or in the weight of load greatly varies the value of the left side member (T2/T1) of Expression 1 to be satisfied. This value increases especially with a reduction in the weight of the cage 1, giving rise to the problem that the cage 1 cannot be reduced in weight.

It is therefore conventional practice to attach a weight to the cage 1 so as not to permit the rope 3 to slip even when the cage carries a small number of passengers. This gives increased weight to the cage 1 itself. The increase in the weight of the cage 1 itself gives rise to the problem of making the lift drive mechanism large-sized and heavier. Furthermore, the drive motor 91 serving as the power source for the lift drive mechanism is given an increased capacity, consequently resulting in increased power consumption and also entailing the problem of necessitating space for the installation of the drive motor 91 which becomes greater in size.

An object of the present invention is to overcome all the foregoing problems by providing a drive mechanism capable of reciprocatingly driving a cage or like movable body without using any traction sheave and an elevator apparatus of the novel reciprocating drive type having the drive mechanism incorporated therein.

DISCLOSURE OF THE INVENTION

The present invention provides a reciprocatingly movable body drive mechanism which comprises a tension member in the form of a rope or belt for reciprocatingly driving a reciprocatingly movable body, and a drive device for driving the tension member longitudinally thereof while pressing a specified region of the tension member sideways in contact with the tension member. The drive device presses a straight region of the tension member in contact with the straight region. Alternatively, the drive device is in contact with a circular-arc region of the tension member as reeved around a sheave for pressing the circular-arc region against the sheave. With the drive mechanism, the drive device drives the tension member by frictional contact therewith to thereby reciprocatingly drive the movable body.

For example, the drive device can be provided by a belt transmission disposed alongside the tension member and revolvingly movable along a tension member extension route, a pressing mechanism for pressing a belt surface of the belt transmission into contact with the tension member, and a drive motor for driving the belt transmission.

The present invention provides an elevator apparatus which comprises a reciprocatingly movable body reciprocatingly movably provided in a path of reciprocating movement, and a mechanism for reciprocatingly driving the body. The reciprocatingly driving mechanism comprises a sheave disposed at a predetermined level, a tension member in the form of a rope or belt and extending along a path around the sheave, and a drive device for driving the tension member in engagement therewith by pressing a specified longitudinal region of the tension member sideways. The term "reciprocatingly movable body" means a cage having a passenger compartment or cargo compartment, and refers to a concept superior to that of a counterweight as a counterpart of the cage. The term "tension member" refers to a concept superior to that of one or a plurality of ropes or belts. The term "reciprocating movement" includes a reciprocating movement in a vertical direction, horizontal direction, oblique direction or direction along a bent or curved path.

Usable as the drive device is a drive device of the first type which drives the tension member by pressing a straight region thereof (hereinafter referred to as the "straight drive type"), or a drive device of the second type which drives the tension member as reeved around at least one sheave disposed along the tension member extension route by pressing a circular-arc region of the tension member against the sheave (hereinafter referred to as the "circular-arc drive type"). Alternatively, the combination of these two types is to be used.

Usable as the drive device of the straight drive type is a device comprising a belt transmission disposed alongside the tension member and revolvingly movable along a tension member extension route, a pressing mechanism for pressing a belt surface of the belt transmission into contact with the tension member, and a drive motor for driving the belt transmission. Usable as the drive device of the circular-arc drive type is a device comprising a belt pressed against the circular-arc region of the tension member and revolvingly movable, a plurality of rollers arranged along a path of revolving movement of the belt, and a drive motor for rotatingly driving at least one of the rollers.

With the elevator apparatus of the invention described, the belt is driven by the drive motor, whereby the tension member is driven by frictional contact with the surface of the belt. As a result, the reciprocatingly movable body is reciprocatingly moved. With the drive device, the tension member can be prevented from slipping under the condition expressed by Mathematical Expression 4 given below, wherein T1 is the tension acting on the slack side of the tension member extending from the drive device toward opposite directions, T2 is the tension on the tensioned side of the tension member, μ is the coefficient of friction between the belt surface of the belt transmission and the tension member, and N is the pressure exerted by the belt surface on the tension member.

(Mathematical Expression 4)

$$T2-T1 \leqq \mu \cdot N$$

Accordingly, assuming, for example, that the tension T1 on the slack side is due to the weight of the reciprocatingly movable body (cage), the tension T1 is small if the cage carries a small number of passengers, whereas the relationship of Mathematical Expression 4 can be satisfied by increasing the pressure N. The tension member can then be prevented from slipping.

Suppose the cage itself has weight of 1500 Kg, the loading capacity is 1000 Kg, and the weight of the counterweight is the weight of the cage itself plus 50% of the loading capacity as exemplified above. The left side member of Expression 4 has the following values when the weight of load is zero and when the cage is fully loaded.

(Mathematical Expressions 5)

$$T2-T1=2000-1500=500$$

$$T2-T1=2500-2000=500$$

If the weight of the cage itself is then reduced to 1000 Kg, the values of Mathematical Expressions 4 are as follows.

(Mathematical Expressions 6)

$$T2-T1=1500-1000=500$$

$$T2-T1=2000-1500=500$$

Thus, the left side member (T2−T1) of Mathematical Expression 4 to be satisfied has a constant value even if the weight of the cage itself or the weight of load varies. The cage can be moved upward or downward without permitting slippage of the tension member if the drive device exerts a drive force greater than this value when driving the tension member in frictional contact therewith.

Without the necessity of altering the tension member extension route, the drive device may be provided along a straight region of the tension member extension route when of the straight drive type, or along a circular-arc region of the tension member as reeved around a sheave when of the circular-arc drive type. Thus, the drive device is accommodated and disposed in the path of movement of the elevator. The drive device can be provided at each of a plurality of locations along the tension member extension route in accordance with the force (T2−T1) required for driving the tension member.

In the case of a drive device of the straight drive type, the belt transmission comprises a main belt 6 reeved around a pair of rollers 53, 54, and the pressing mechanism comprises a subbelt transmission provided by a pair of rollers 64, 65 arranged inside the main belt 6 and a subbelt 62 reeved around the rollers 64, 65, a plurality of pressing rollers 68 arranged inside the subbelt 62 and spring means for pressing the pressing rollers 68 against the main belt 6.

With this specific construction, the pressing rollers 68 are pressed toward the subbelt 62 by the biasing force of the spring means, whereby the subbelt 62 is pressed against the main belt 6, pressing the surface of the main belt 6 into contact with the tension member. The subbelt 62 is free to move revolvingly with the revolving movement of the main belt 6, with rolling friction merely occurring between the subbelt 62 and the pressing rollers 68, so that the pressing mechanism is unlikely to offer resistance to the drive of the main belt 6. The pressing mechanism is not limited only to one utilizing the resilient force of springs 57 or the like, but also usable is, for example, a mechanism utilizing a magnetic force or a fluid pressure.

Stated specifically, an inner periphery of the main belt 6 and an outer periphery of the subbelt 62 have respective grooved surfaces meshable with each other. This reliably prevents slippage from occurring between the main belt 6 and the subbelt 62.

Further stated specifically, the belt providing the belt transmission has a grooved portion extending longitudinally of the tension member and in contact with the tension member. This provides an increased frictional force between the belt and the tension member to produce a greater drive force. An increased frictional force is available also by making the belt and the tension member rough-surfaced over the portions thereof to be in contact with each other.

The drive device of the straight drive type further comprises a second belt transmission positioned as opposed to the belt transmission (first belt transmission), and the tension member is held between surfaces of belts of the respective belt transmissions from opposite sides of the tension member. The force with which the main belt 6 of the first belt transmission presses the tension member is supported by the main belt of the second belt transmission, and the tension member is reliably held between the two belt surfaces, whereby a greater drive force can be produced.

Incidentally, the belt transmission need not always comprise a striplike belt reeved around a pair of rollers but can be provided by a chain 7 reeved around a pair of chain sprockets and a plurality of pressure members 71 arranged on the chain 7 over the entire periphery thereof. Each of the pressure members 71 is provided with a recessed face extending longitudinally of the tension member and shaped in conformity with the cross section of the tension member, whereby a great frictional force can be produced between the pressure member 71 and the tension member.

When the pressing mechanism is provided with an adjusting mechanism for giving an adjusted pressure in accordance with the weight of a cage 1, the value of the right side member of Mathematical Expression 4 can be altered, for example, in accordance with the number of passengers. The tension member can then be prevented from slipping regardless of the number of passengers. Usable as the adjusting mechanism is, for example, a power transmission utilizing the tension of the tension member as motive power for exerting pressure on the belt surface of the belt transmission. The tension of the tension member then varies with the number of passengers, whereby the pressure is made automatically adjustable. Incidentally, the adjusting mechanism is not limited only to a mechanical power transmission such as one using a lever mechanism. Also usable is a power transmission comprising a sensor for detecting the tension of the tension member, and a control circuit for adjusting the pressure in response to the detection signal.

On the other hand, an example of drive device of the circular-arc drive type comprises a mechanism for tensioning the belt. This effectively presses the belt into contact with the tension member to produce a great frictional force between the belt and the tension member.

Further stated specifically, the tensioning mechanism comprises a frame 130 supported so as to be movable toward or away from the sheave, the plurality of rollers being rotatably supported by the frame 130, and the tension member has one end connected to a free end of the frame 130. With this construction, the frame 130 is driven toward the sheave by the tension of the tension member, and the belt extending over the rollers is pressed into contact with the circular-arc region of the tension member as reeved around the sheave. Consequently, the belt can be given sufficiently great tension at all times. Accordingly, the tensioning mechanism requires no special power source and consequently becomes simple in construction.

Alternatively, the tensioning mechanism comprises a frame 130 supported so as to be movable toward or away from the sheave, the plurality of rollers being rotatably supported by the frame 130, and a lever mechanism 140 is provided between a free end of the frame 130 and one end of the tension member. With this specific construction, the lever mechanism 140 converts the tension of the tension member to a force for driving the frame 130, with the portion of the lever mechanism 140 connected to the end of the tension member serving as a fulcrum and with the portion thereof opposed to the free end of the frame 130 serving as the point of application. In this way, the tension of the belt is adjusted to an acting force of required magnitude.

Further stated specifically, the tensioning mechanism comprises an arm 156 supported so as to be movable toward or away from the sheave, the arm 156 being elastically biased toward a direction away from the sheave, and a plurality of rollers included among the plurality of rollers and positioned at opposite ends of the arrangement of rollers are rotatably supported each at a predetermined level relative to the sheave, the arm 156 rotatably supporting thereon one or more rollers positioned inwardly of the roller arrangement. With this specific arrangement, the arm 156 is biased toward a direction away from the sheave, whereby the inward roller or rollers are driven away from the sheave to tension the belt.

The elevator apparatus of the invention described above has a drive device for driving a tension member in frictional contact therewith. This obviates the need for driving by a traction sheave, rendering the cage or like reciprocatingly movable body smaller in weight and consequently permitting use of a compacted lightweight lift drive mechanism.

BEST MODE OF CARRYING OUT THE INVENTION

Embodiments of the invention will be described below in detail with reference to the drawings. First, a description will be given of an elevator apparatus wherein a drive device of the straight drive type is used as a drive device for driving ropes, serving as tension members, by frictional contact therewith, i.e., by pressing a straight region of each rope. Subsequently, a description will be given of an elevator apparatus wherein a drive device of the circular-arc drive type is used for driving ropes as reeved around a sheave by pressing a circular-arc region of each rope against the sheave.

Apparatus Comprising Drive Device of Straight Drive Type

Figure 1:
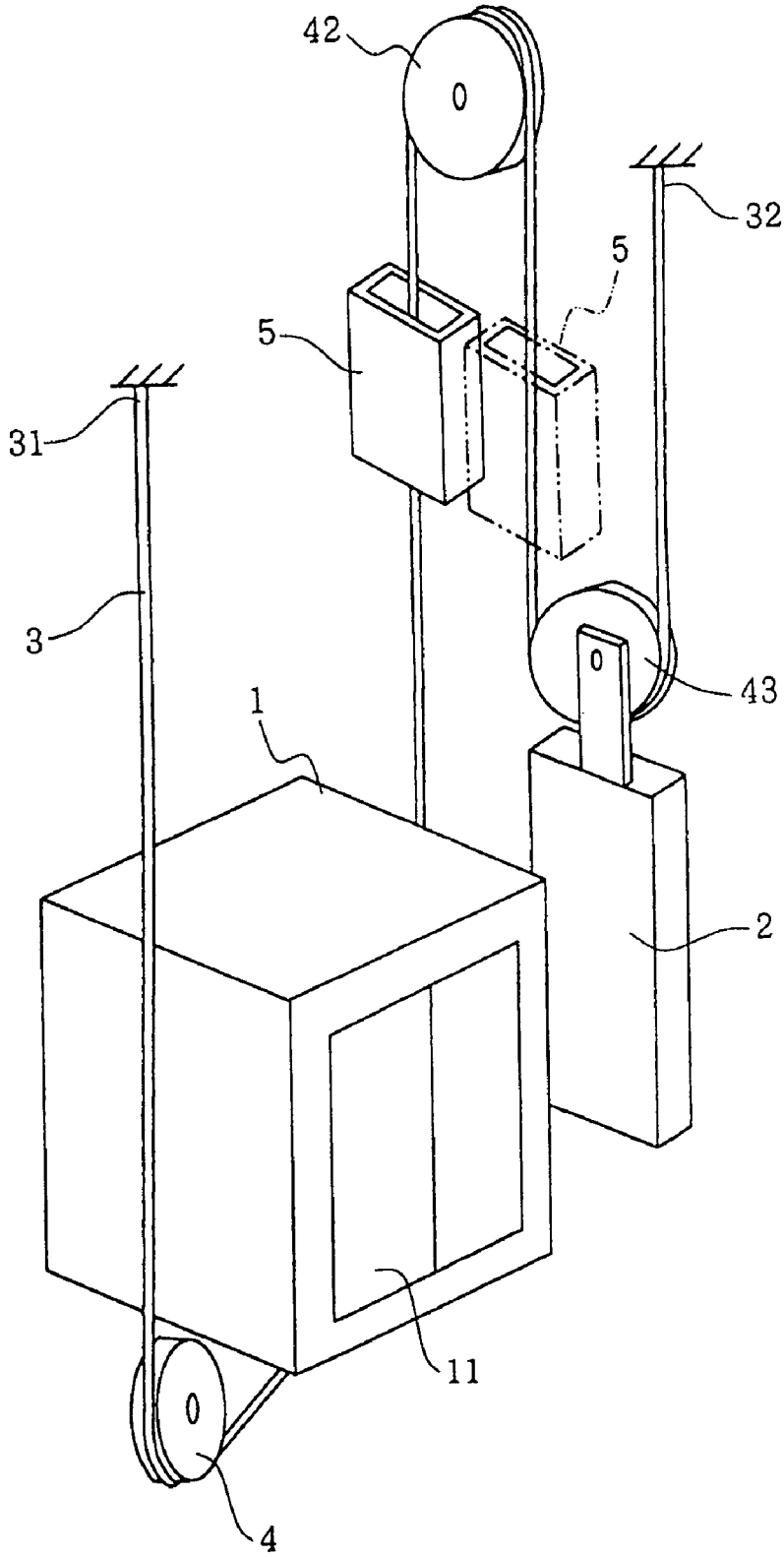
FIG. 1 is a perspective view showing the basic construction of an elevator apparatus equipped with a drive device of the straight drive type.

FIG. 1 shows the basic construction of an elevator apparatus of the invention wherein a drive device of the straight drive type is used. As illustrated, a rope 3 extends as reeved around a plurality of sheaves, such as a sheave 42 provided at a specified position within a path of movement of the elevator and sheaves 4, 43 attached to a cage 1 and a counterweight 2. A drive device 5 for driving the cage 1 upward or downward is provided along the route of the rope 3, and rope ends 31, 32 are fixed in position.

Figure 3:
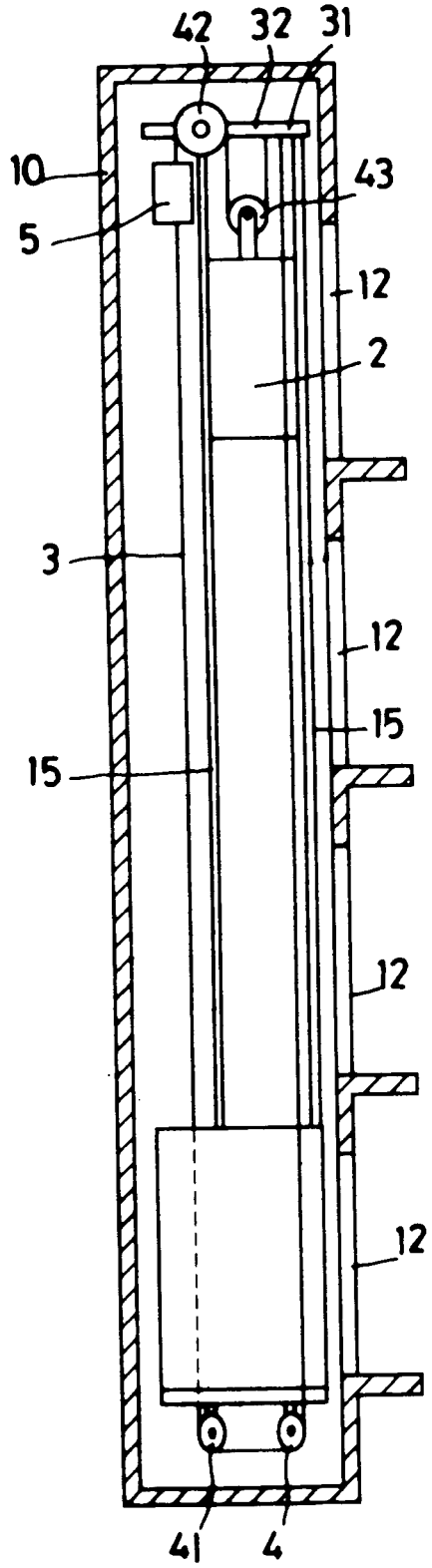
FIG. 3 is a side elevation showing an arrangement inside a path of movement of the elevator apparatus.
Figure 4:
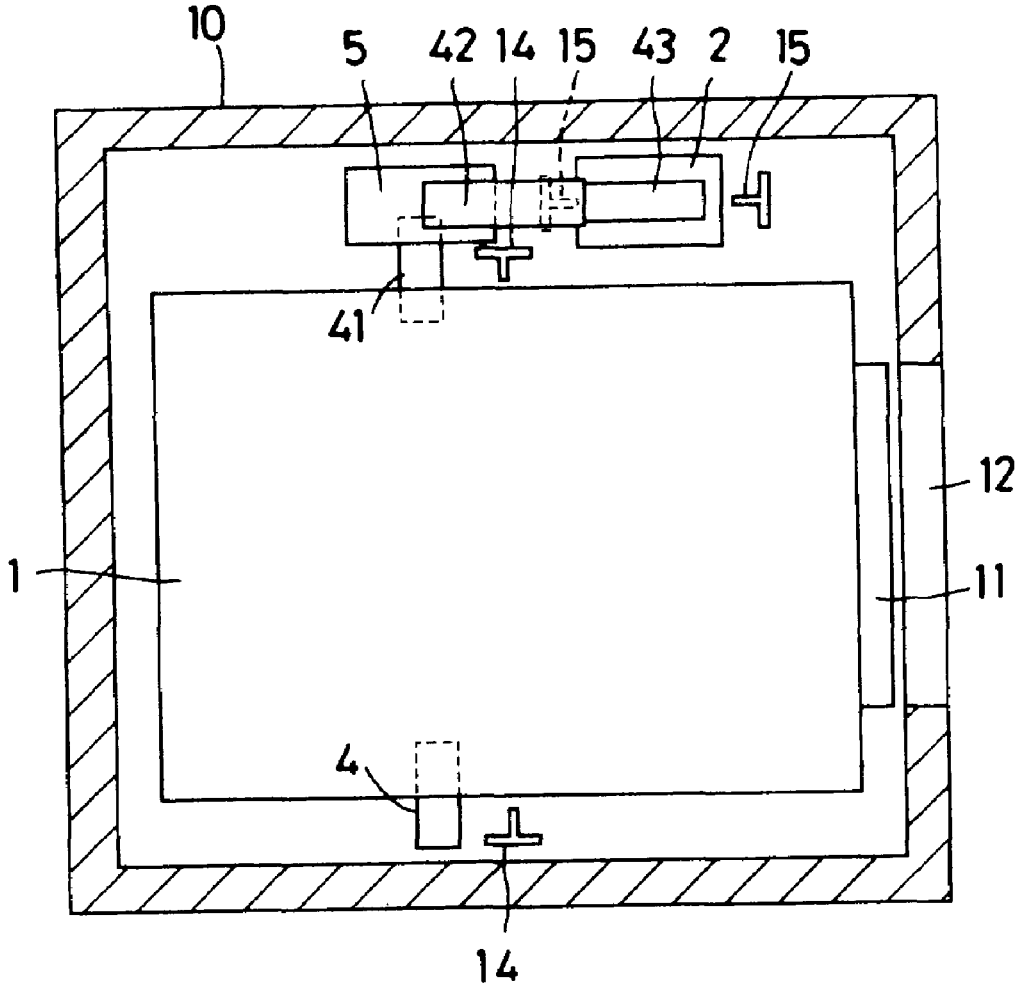
FIG. 4 is a plan view showing the same arrangement.

FIGS. 3 and 4 show an arrangement inside a path 10 of movement of the elevator apparatus of the invention. As illustrated, the cage 1, counterweight 2, sheaves 42, 4, 41, 43 and drive device 5 are arranged in the path 10. The cage 1 is guided by guide rails 14, 14 for upward or downward movement, and the counterweight 2 is guided by guide rails 15, 15 for upward or downward movement.

The drive device 5 has connected thereto an unillustrated control circuit for controlling the upward and downward movement of the cage 1 and stopping of a cage door 11 at a position coinciding with a floor door 12. Although only one rope 3 is shown in FIGS. 1 and 3 for the sake of simplicity, a plurality of ropes extend along the same route in actuality. The ropes are not shown in FIG. 4.

Figure 2:
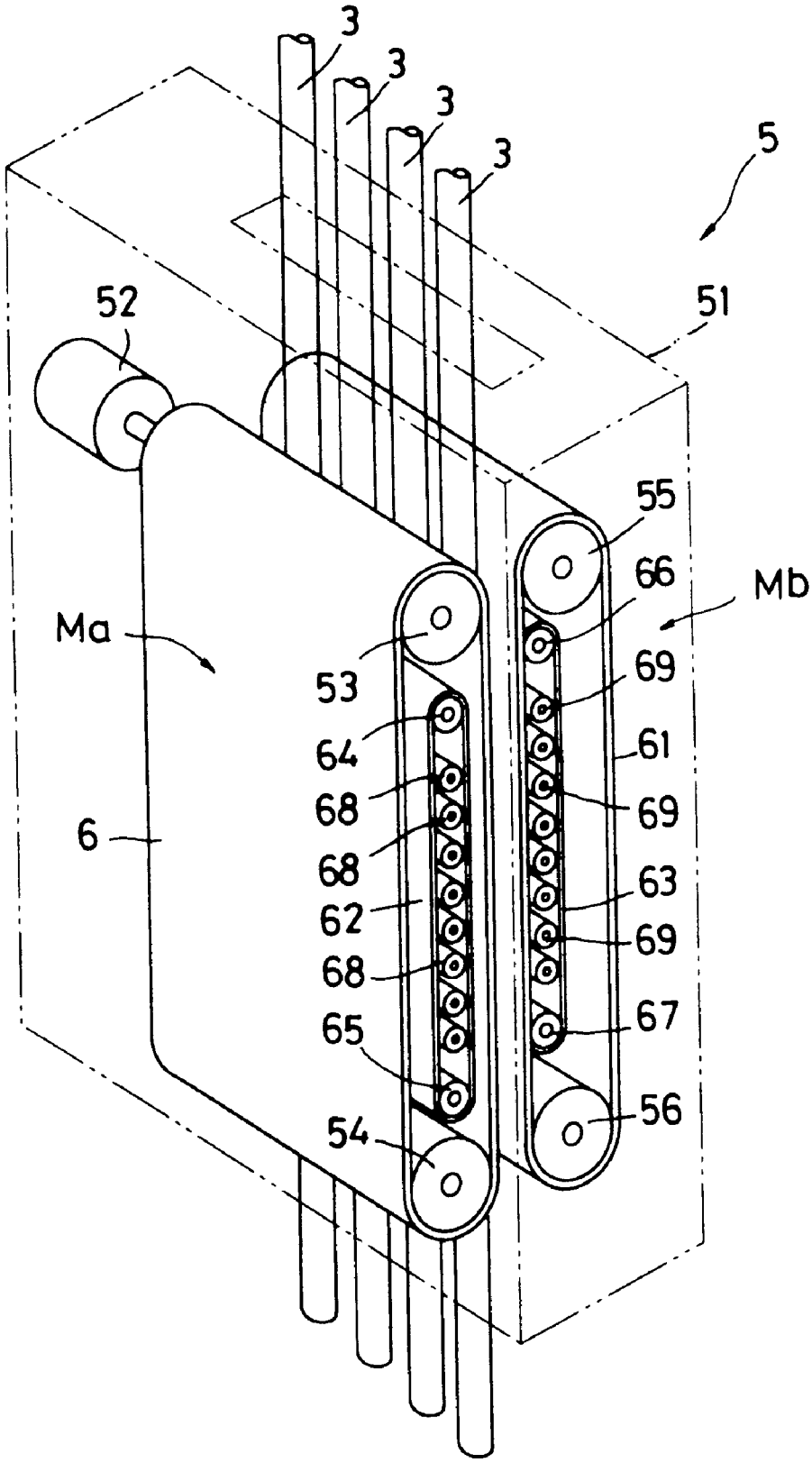
FIG. 2 is a perspective view showing the construction of the drive device of the straight drive type.
Figure 5:
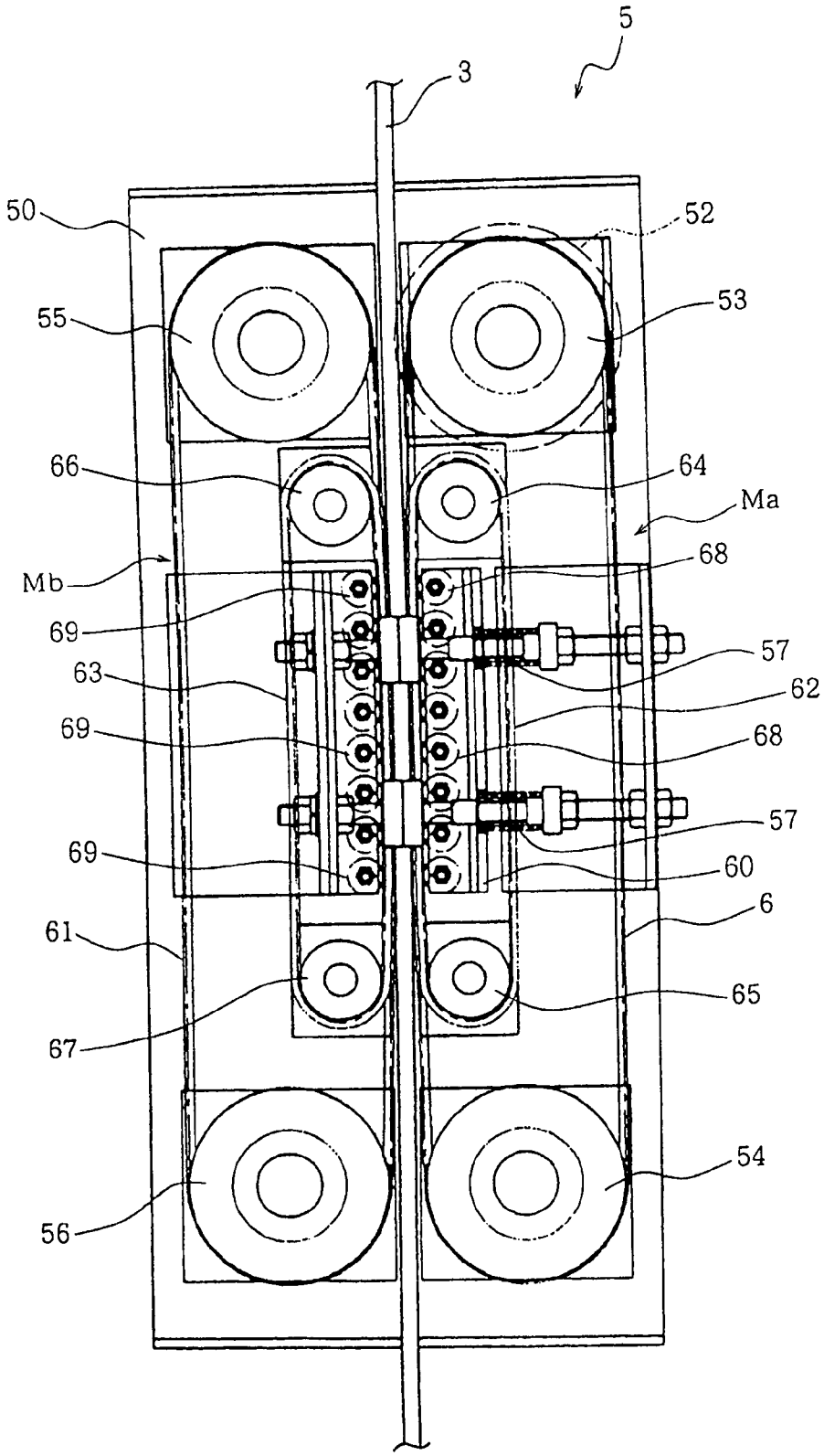
FIG. 5 is a plan view showing in detail the construction of the drive device of the straight drive type.
Figure 6:
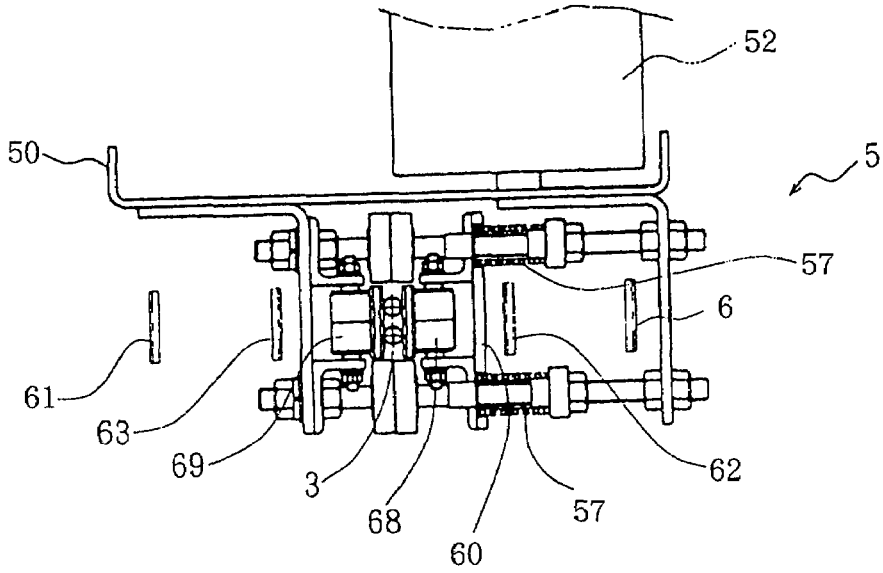
FIG. 6 is a plan view showing the same construction.

FIG. 2 shows the construction of the drive device 5, and FIGS. 5 and 6 show the construction of the drive device 5 in greater detail. With reference to FIG. 2, the drive device 5 comprises a pair of drive-side belt drive mechanism Ma and driven-side belt drive mechanism Mb which are arranged inside a housing 51. The belt drive mechanism Ma on the drive side comprises a main belt transmission comprising a pair of rollers 53, 54 arranged along the ropes 3 and a main belt 6 reeved around these rollers, a drive motor 52 for rotatingly driving the roller 53 of the main belt transmission, a subbelt transmission comprising a pair of rollers 64, 65 arranged inside the main belt 6 and a subbelt 62 reeved around the rollers 64, 65, and a plurality of pressing rollers 68 arranged inside the subbelt 62.

On the other hand, the belt drive mechanism Mb on the driven side comprises a main belt transmission comprising a pair of rollers 55, 56 arranged along the ropes 3 and a main belt 61 reeved around these rollers, a subbelt transmission comprising a pair of rollers 66, 67 arranged inside the main belt 61 and a subbelt 63 reeved around the rollers 66, 67, and a plurality of support rollers 69 arranged inside the subbelt 63. In each of the two belt drive mechanisms Ma, Mb, the outer peripheral surface of the subbelt 62 or 63 on the rope side is in intimate contact with the inner peripheral surface of the main belt 6 or 61 on the rope side.

With reference to FIGS. 5 and 6, the rollers 53 to 56 and 64 to 67 providing the two belt drive mechanisms Ma, Mb and the support rollers 69 providing the driven-side belt drive mechanism Mb are rotatably supported on a fixed frame 50, while the pressing rollers 68 providing the drive-side belt drive mechanism Ma are rotatably supported on a movable base 60 which is reciprocatingly movably supported by the fixed frame 50 and are movable toward or away from the subbelt 62. The fixed frame 50 is provided with a plurality of springs 57 for biasing the movable base 60 toward the subbelt 62. The biasing force causes the pressing rollers 68 to press the subbelt 62 toward the main belt 6, whereby the belt surface of the main belt 6 is pressed into contact with the ropes 3. Consequently, the pressure N of Mathematical Expression 4 is produced between the belt surface of the main belt 6 and the ropes 3. Thus, the subbelt transmission provides a pressing mechanism for the main belt 6.

When the power source is turned on for the drive motor 52 constituting the drive-side belt drive mechanism Ma of the drive device 5, the main belt 6 starts to move revolvingly, drawing the ropes 3 toward one direction by a frictional force between the main belt 6 and the ropes 3. With this movement, the main belt 61 of the driven-side belt drive mechanism Mb moves revolvingly. Further with the revolving movement of the two main belts 6, 61, the two subbelts 62, 63 also move revolvingly.

The traction of the ropes 3 in one direction moves the sheave mechanism shown in FIG. 1, which moves the cage 1 and the counterweight 2 upward or downward in directions opposite to each other. Produced between the belt surface of the main belt 6 and the ropes 3 in this process is pressure N satisfying Mathematical Expression 4 due to the biasing force of the springs 57, consequently obviating the slippage to be produced between the main belt 6 and the ropes 3.

In the case of the elevator apparatus of the invention, the drive device 5 can be installed compactly in a vacant space along the route of the ropes within the path 10 as shown in FIGS. 3 and 4. This eliminates the need to provide an additional installation space for the device 5. Further when required, a second drive device 5 can be disposed in another vacant space as indicated in chain lines in FIG. 1.

Figure 7:
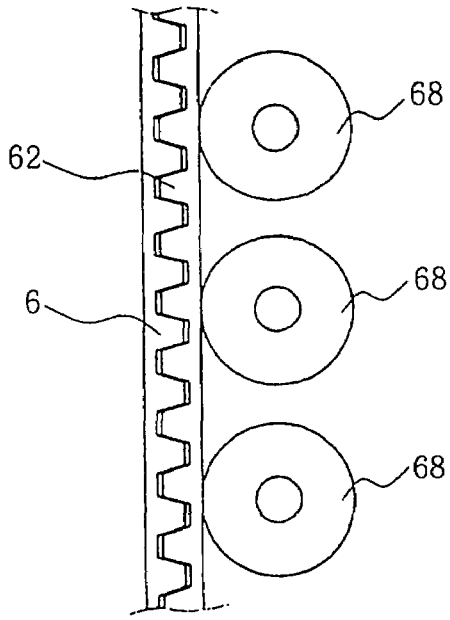
FIG. 7 is a front view showing a main belt and a subbelt meshing therewith.
Figure 8:
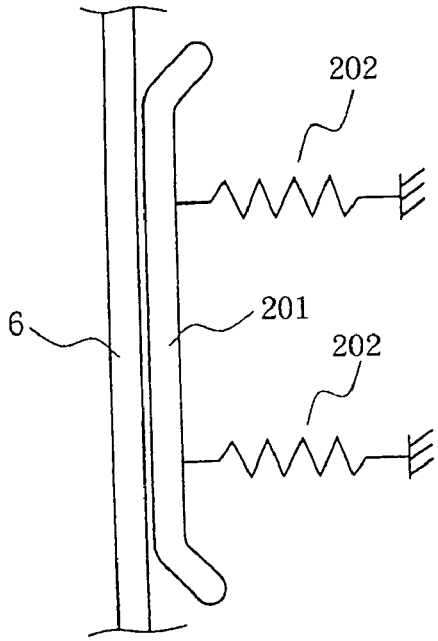
FIG. 8 is a front view showing the construction of another pressing mechanism.

When the outer periphery of the subbelt 62 and the inner periphery of the main belt 6 have respective grooved surfaces meshable with each other as shown in FIG. 7, the main belt 6 and the subbelt 62 can be prevented from slipping on each other. Usable as the pressing mechanism for the main belt 6 is an arrangement comprising a pressure plate 201 disposed alongside the main belt 6, and springs 202 for biasing the pressure plate 201 toward the main belt 6 to apply pressure to the main belt 6 as shown in FIG. 8.

Figure 9:
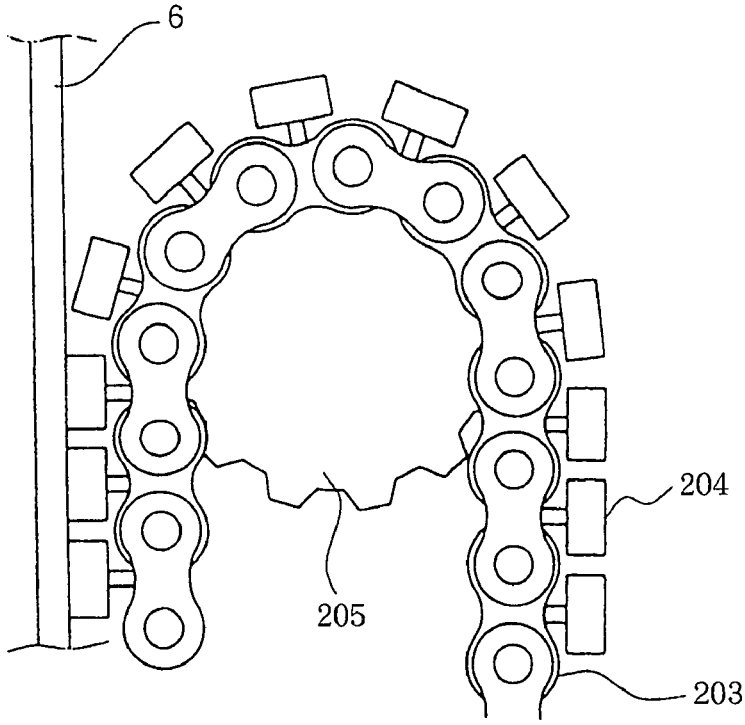
FIG. 9 is a front view showing the construction of another pressing mechanism.

Alternatively usable is a mechanism comprising, as shown in FIG. 9, a pair of chain sprockets 205, 205, a chain 203 reeved around the sprockets, and slats 204 attached to the chain 203 and arranged over the entire periphery of the chain, the slats 204 being pressed against the main belt 6 by unillustrated respective springs. The slats 204 are arranged in a row for each rope or each of groups of ropes.

Figure 10:
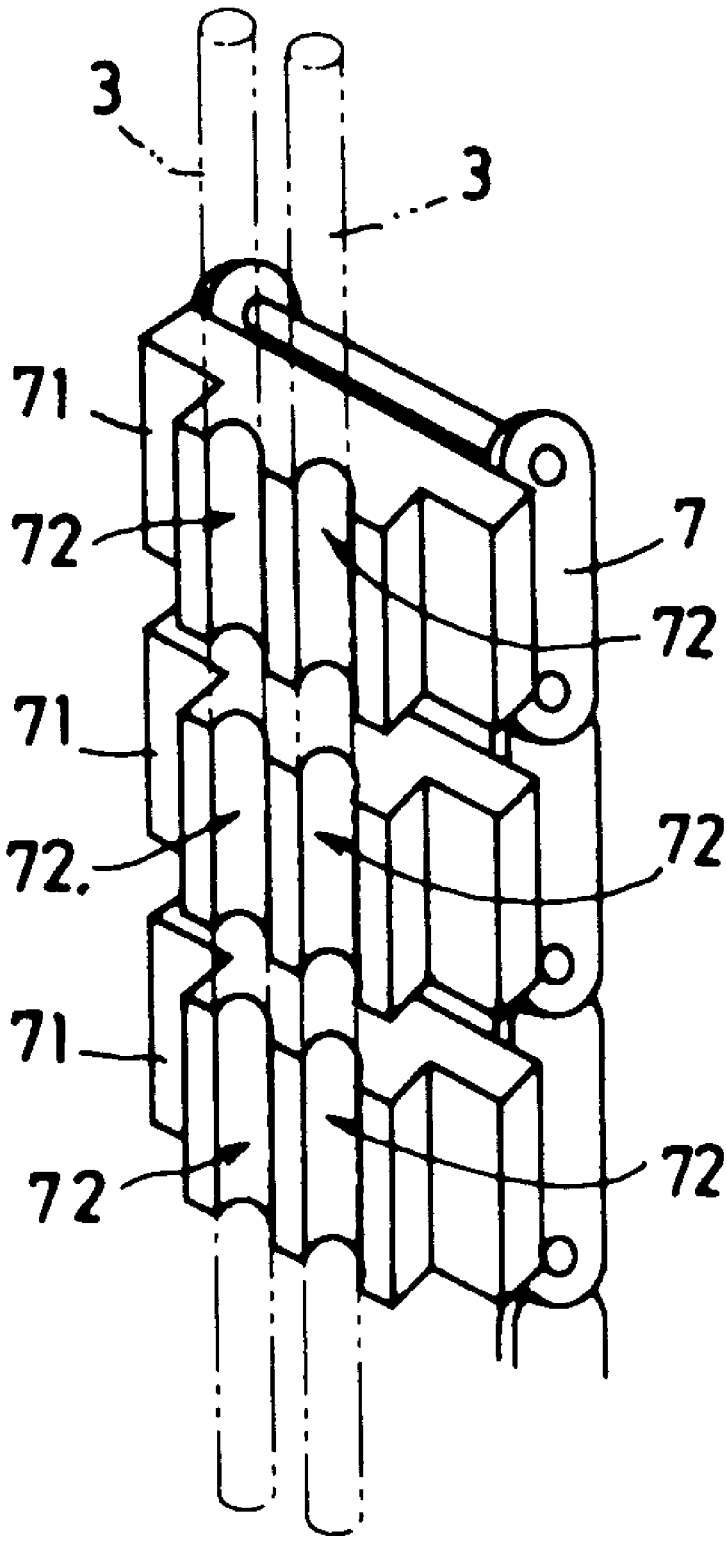
FIG. 10 is a perspective view of a belt transmission comprising a chain.

It is also possible to use a belt transmission comprising, as shown in FIG. 10, a pair of chain sprockets (not shown), a chain 7 reeved around the sprockets and a plurality of pressure members 71 arranged on the chain 7 over the entire periphery thereof. Each of the pressure members 71 is provided with recessed curved faces 72 extending longitudinally of the ropes 3 and shaped in conformity with the cross section of the ropes 3, whereby a great frictional force can be produced between the pressure member 71 and the ropes 3.

Figure 11:
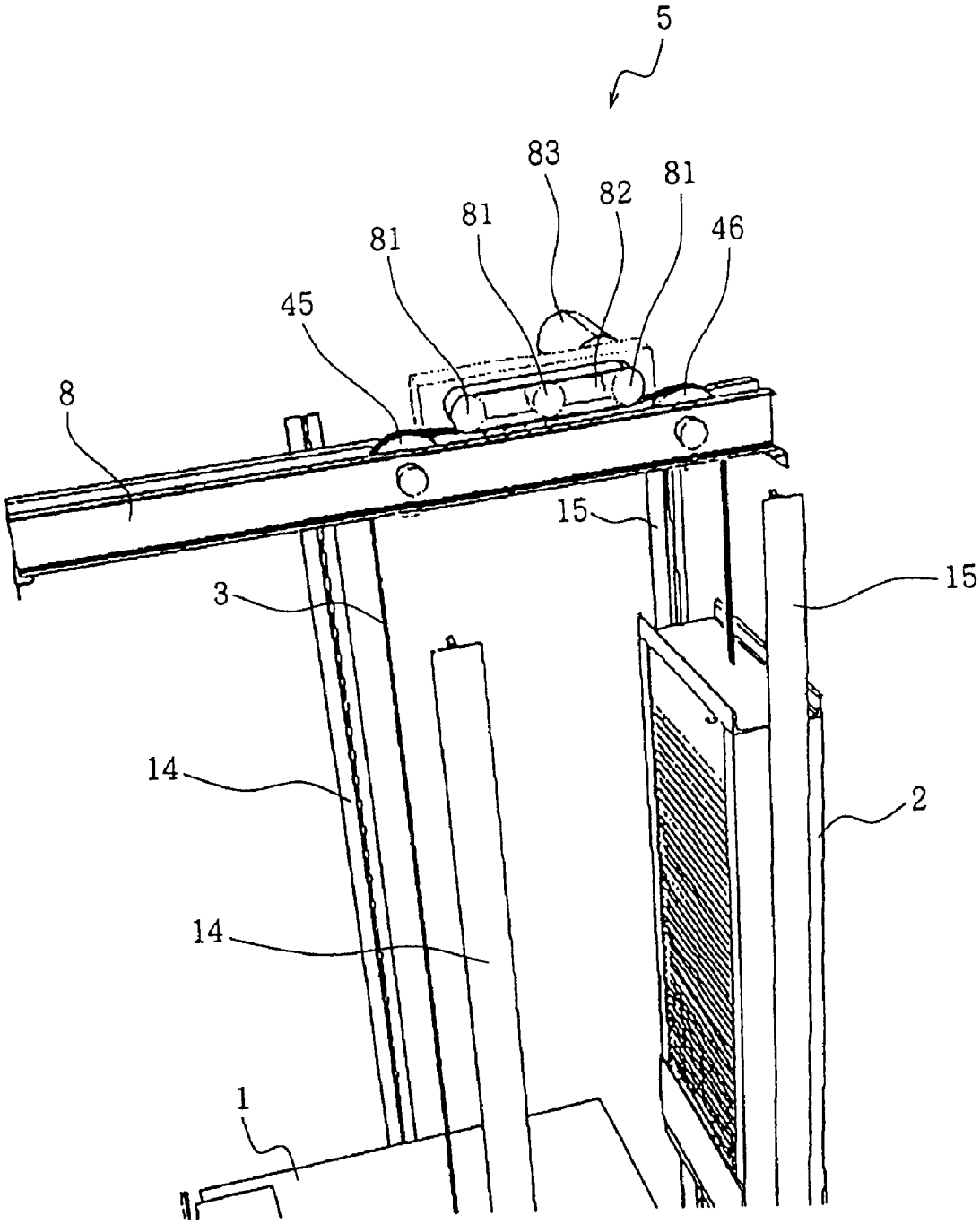
FIG. 11 is a perspective view showing the construction of another drive device of the straight drive type.

FIG. 11 shows the construction of another elevator apparatus of the invention. A rope 3 connecting a cage 1 to a counterweight 2 is reeved around two sheaves 45, 46 rotatably supported on a frame 8. A drive device 5 is provided along the rope 3 extending between the two sheaves 45, 46. The drive device 5 comprises a plurality of pressing rollers 81, 81, 81, a belt 82 reeved around these rollers 81, 81, 81 and a drive motor 83 for driving one pressing roller 81. The rollers 81, 81, 81 press the belt 82 into contact with the rope 3.

Figure 12:
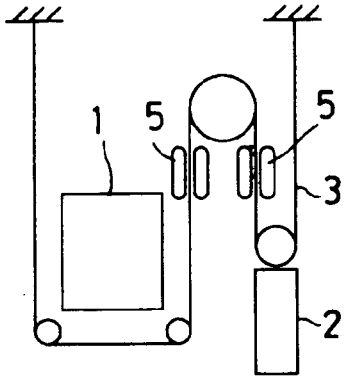
FIG. 12 includes diagrams showing exemplary arrangements of devices in elevator apparatus each comprising a drive device of the straight drive type.
Figure 12:
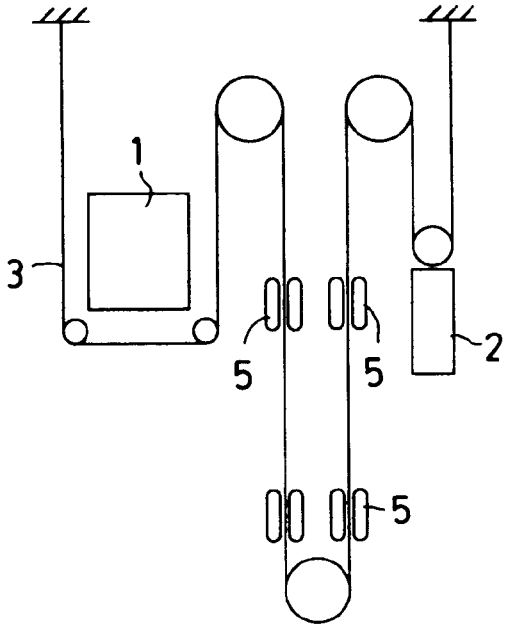
Figure 12:
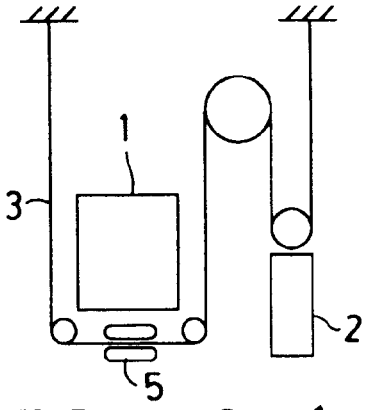
Figure 12:
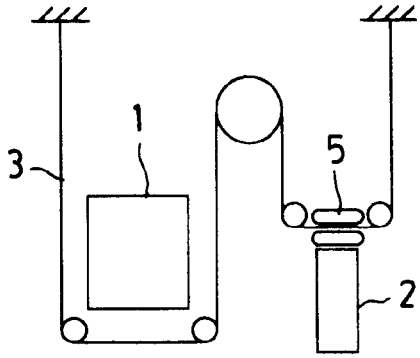
Figure 12:
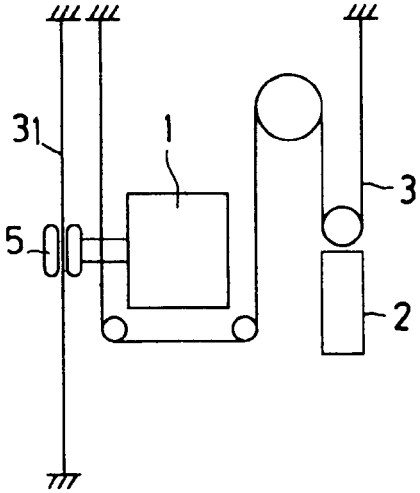
Figure 12:
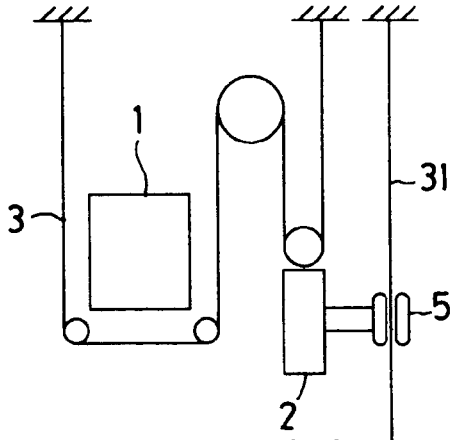

FIGS. 12,(*a*) to (*f*) and 13,(*a*) to (*f*) show other examples of arrangements which are altered in the number and position of drive devices 5, the number and position of sheaves, rope extension route, etc. FIGS. 12,(*a*) and (*b*) show drive devices 5 arranged at a plurality of locations. FIG. 12,(*c*) shows a drive device 5 attached to a cage 1. FIG. 12,(*d*) shows a drive device 5 attached to a counterweight 2. FIGS. 12,(*e*) and (*f*) each show a rope 31, other than a rope 3 as the main cable and serving as an auxiliary cable. A drive device 5 is in engagement with the rope 31.

Figure 13:
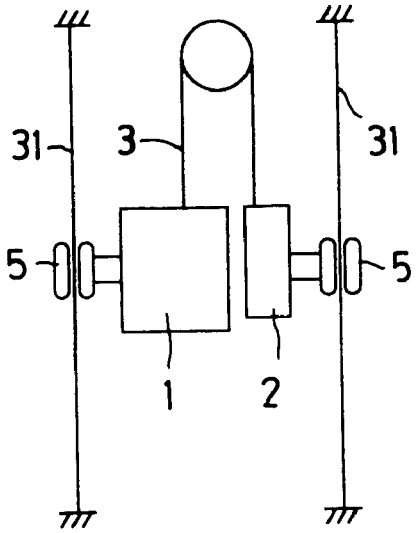
FIG. 13 includes diagrams showing examples of other arrangements.
Figure 13:
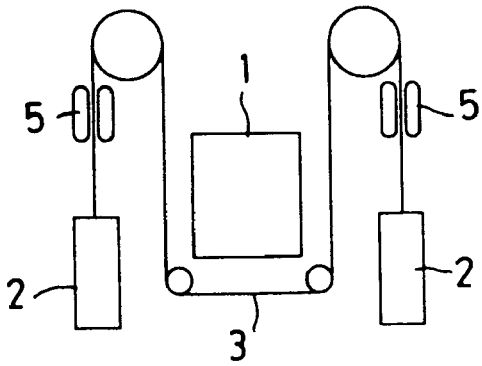
Figure 13:
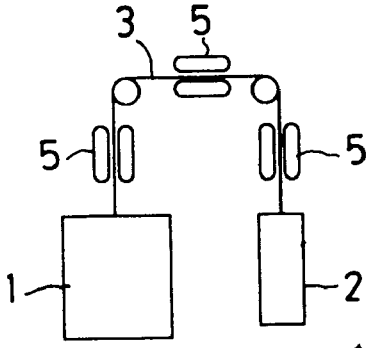
Figure 13:
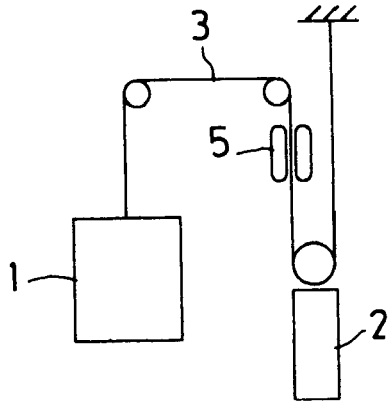
Figure 13:
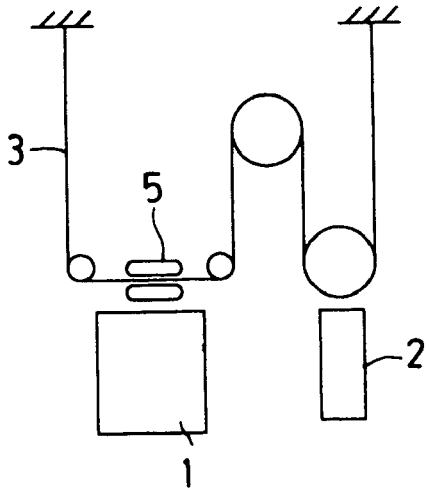
Figure 13:
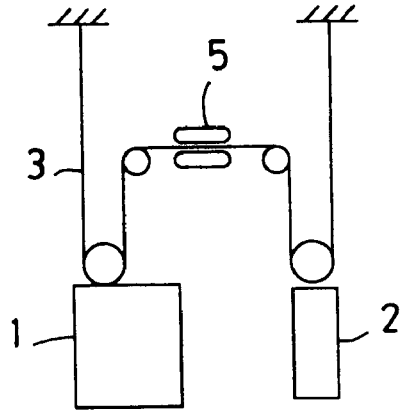

With reference to FIG. 13,(*a*), a rope 3 has connected to opposite ends thereof a cage 1 and a counterweight 2, to which respective drive devices 5, 5 are attached. Each drive device 5 is in engagement with a rope 31 serving as an auxiliary cable. FIG. 13,(*b*) shows counterweights 2, 2 attached to respective opposite ends of a rope 3. FIG. 13, (*c*) shows a cage 1 and a counterweight 2 connected to the respective ends of a rope 3, which is in engagement with a drive device 5. FIG. 13,(*d*) shows a cage 1 connected to one end of a rope 3, which is in engagement with a drive device 5. FIG. 13,(*e*) shows a pair of sheaves and a drive device 5 which are mounted on the ceiling portion of a cage 1. The drive device 5 is in engagement with the portion of the rope 3 between the two sheaves. FIG. 13,(*f*) further shows a drive device 5 in engagement with a rope 3 at the portion thereof between two sheaves, which are provided inside a path of movement of the elevator. With the elevator apparatus of the invention, drive devices 5 can be arranged with great freedom, so that various arrangements can be realized as shown in FIGS. 12 and 13.

Figure 14:
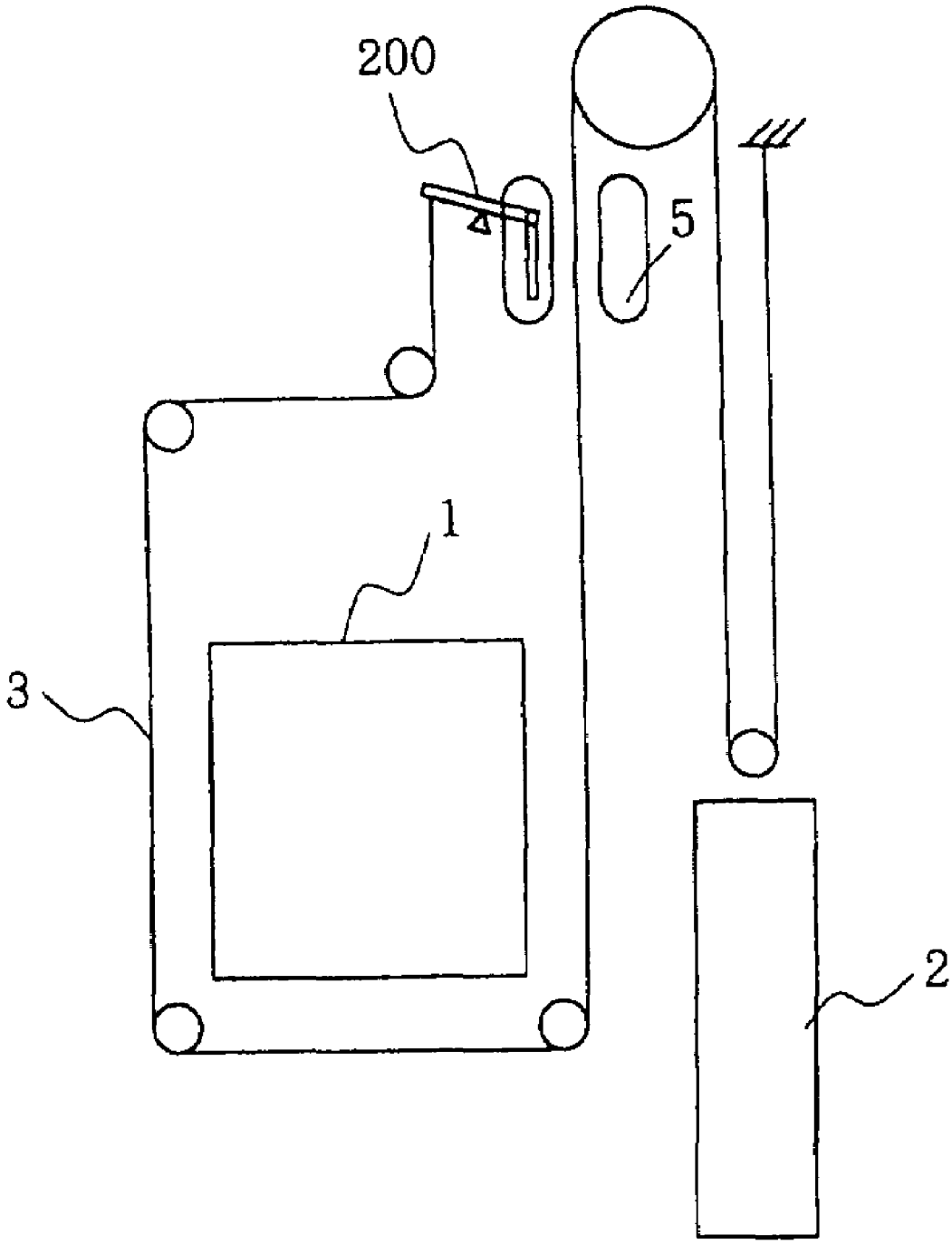
FIG. 14 is a diagram showing another exemplary arrangement wherein a lever mechanism is used.

FIG. 14 shows another elevator apparatus, wherein the tension produced on the rope 3 is caused to act on a fulcrum for a lever mechanism 200, and a belt surface of a drive device 5 is pressed against the rope 3 with a force produced at the point of application of the lever mechanism 200. With this elevator apparatus, the tension of the rope 3, i.e., a pressure corresponding to the weight of the cage 1, can be caused to act on the drive device 5, so that the pressure can be adjusted automatically in accordance with the number of passengers in the cage 1. Thus, the slippage between the rope 3 and the drive device 5 can be prevented regardless of the number of passengers.

As described above, the elevator apparatus of the invention is equipped with a drive device 5 for exerting a drive force in accordance with the difference between tension T1 on the slack side of a rope 3 and the tension T2 on the tensioned side of the rope. This eliminates the need for the conventional mode of driving by a traction sheave, making it possible to use a cage 1 or counterweight 2 of reduced weight. Furthermore the following advantages are also available.

1. Although the drive device is installed conventionally only in a machine room, an upper portion of a path of movement of the elevator, pit or the like, the device can be installed at any location according to the invention.

2. Since the rope is driven as held at a straight region thereof, the rope is less burdened, permitting use of various materials, such as iron or steel, synthetic fibers and synthetic resins, for the rope.

3. The conventional drive device using a traction sheave needs to support the weight of the cage and the counterweight and is therefore large-sized, whereas the drive device of the invention need not support the weight of these components and can therefore be compacted and reduced in weight. Furthermore, the drive device can singly be removed or installed and is easy to replace.

4. The cage 1 and the counterweight 2 which are reduced in weight permit use of a drive motor 52 of smaller capacity, which results in reduced power consumption.

5. An increase in the pressure to be exerted by the drive device 5 increases the force for driving the rope 3. This makes it more likely that the chain or rope to be used as a counterbalance can be dispensed with, hence improved safety or reliability.

Apparatus Comprising Drive Device of Circular-Arc Drive Type

Figure 15:
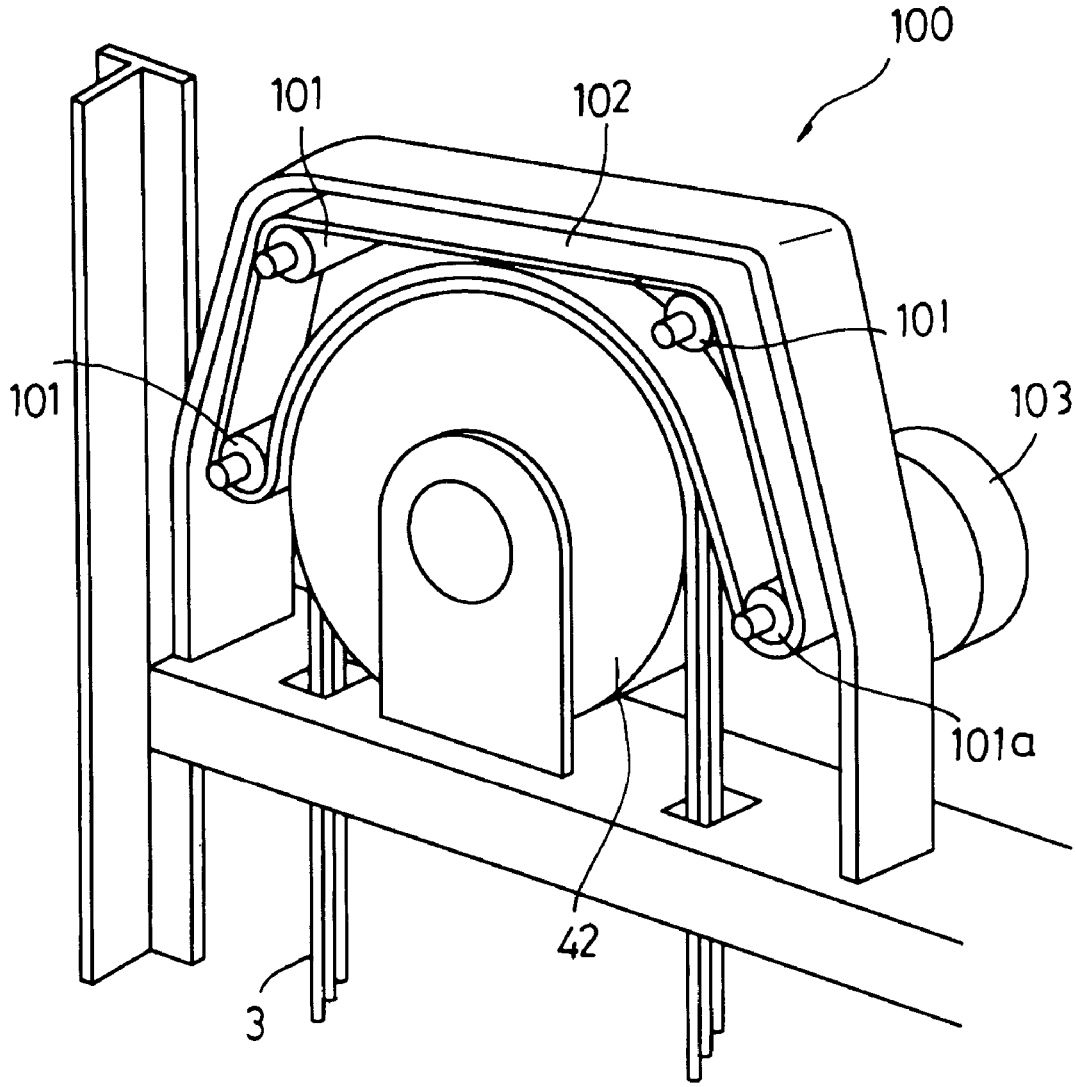
FIG. 15 is a perspective view of a drive device of the circular-arc drive type.

FIGS. 15 to 22 show examples of elevator apparatus of the invention wherein a drive device of the circular-arc drive type is used. FIG. 15 shows a drive device 100, which is provided along a sheave 42 disposed at a specified level within a path of movement of the elevator. The drive device 100 comprises a belt 102 reeved around four rollers 101, 101, 101, 101*a* arranged along the outer periphery of the sheave 42, and a motor 103 coupled to the roller 101*a* among the rollers. About one-half of the circumferential length of the belt 102 is curved in a circular-arc form along the outer periphery of the sheave 42, pressing circular-arc regions of ropes 3 as reeved around the sheave 42 against the sheave 42. When the belt 102 is revolvingly moved by driving the motor 103, the ropes 3 are driven by a frictional force acting between the belt 102 and the ropes 3.

Figure 16:
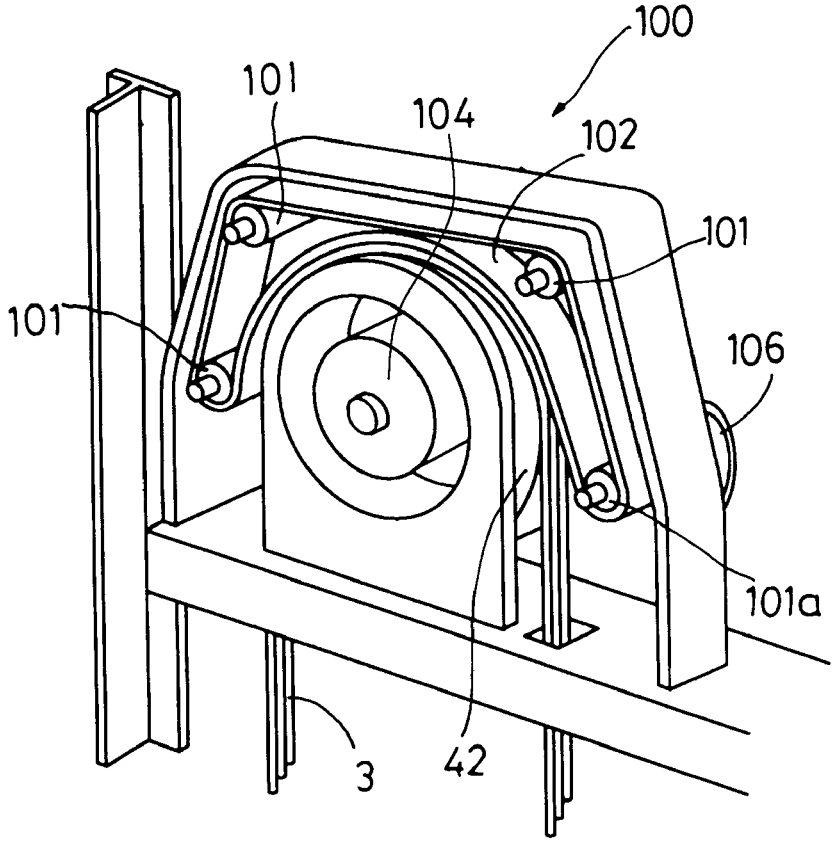
FIG. 16 is a perspective view of another drive device of the circular-arc drive type.
Figure 17:
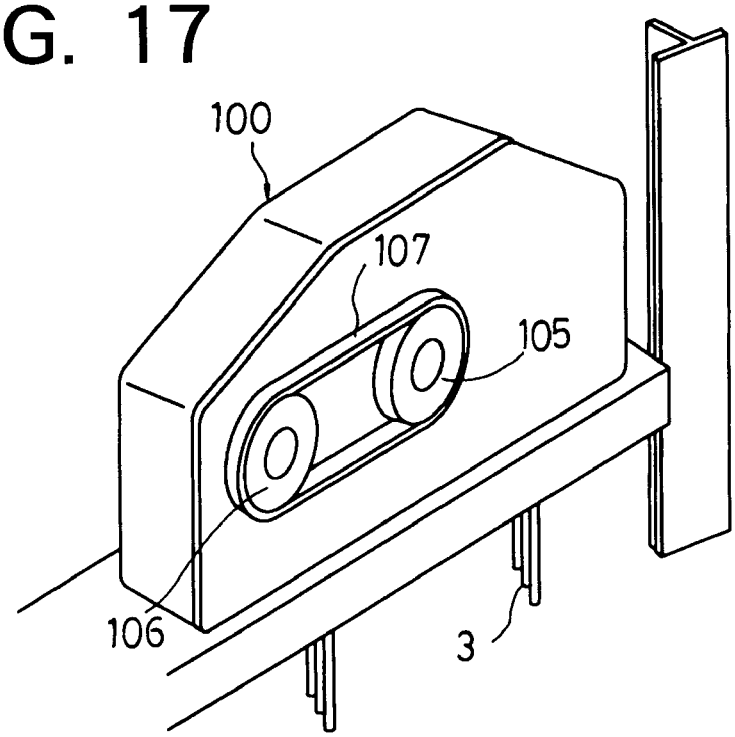
FIG. 17 is a perspective view showing the construction of rear side of the drive device.

FIG. 16 shows a drive device 100 having a motor 104 serving as a drive source and installed in a hollow space formed in the center of a sheave 42. A drive pulley 105 is mounted on the output shaft of the motor 104, and the rotation of the drive pulley 105 is transmitted to a driven pulley 106 by a belt 107 as seen in FIG. 17. A roller 101*a* shown in FIG. 16 is connected to the driven pulley 106. The rotation of the motor 104 is transmitted to the roller 101*a* via the drive pulley 105, belt 107 and driven pulley 106, whereby a belt 102 is rotated revolvingly to drive ropes 3 in frictional contact therewith.

Figure 18:
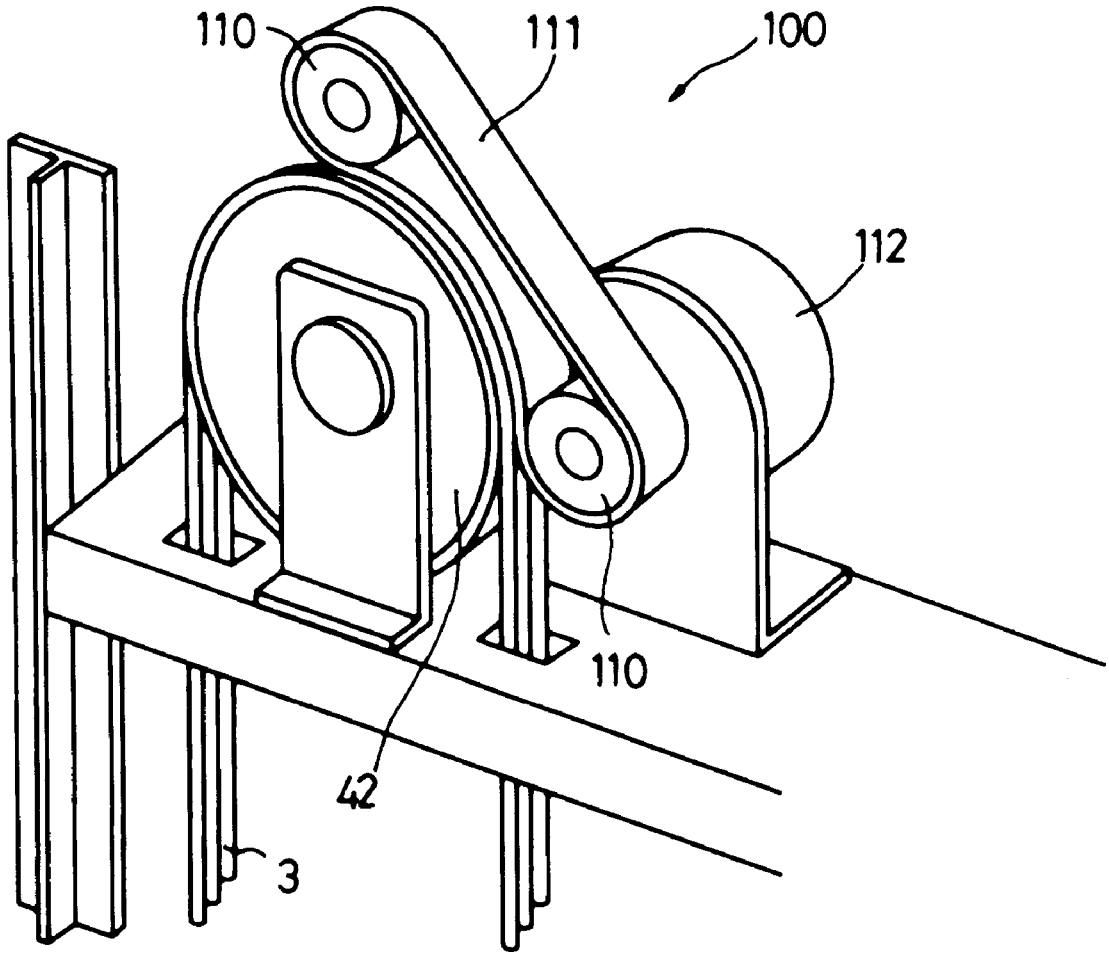
FIG. 18 is a perspective view of another drive device of the circular-arc drive type.

FIG. 18 shows a drive device 100, wherein a belt 111 is reeved around two rollers 110, 110, and a motor 112 is coupled to one of the rollers 110. About one-half of the circumferential length of the belt 111 is curved in a circular-arc form along the outer periphery of a sheave 42, pressing circular-arc regions of ropes 3 as reeved around the sheave 42 against the sheave 42. When the belt 111 is revolvingly moved by driving the motor 112, the ropes 3 are driven by a frictional force acting between the belt 111 and the ropes 3.

Figure 19:
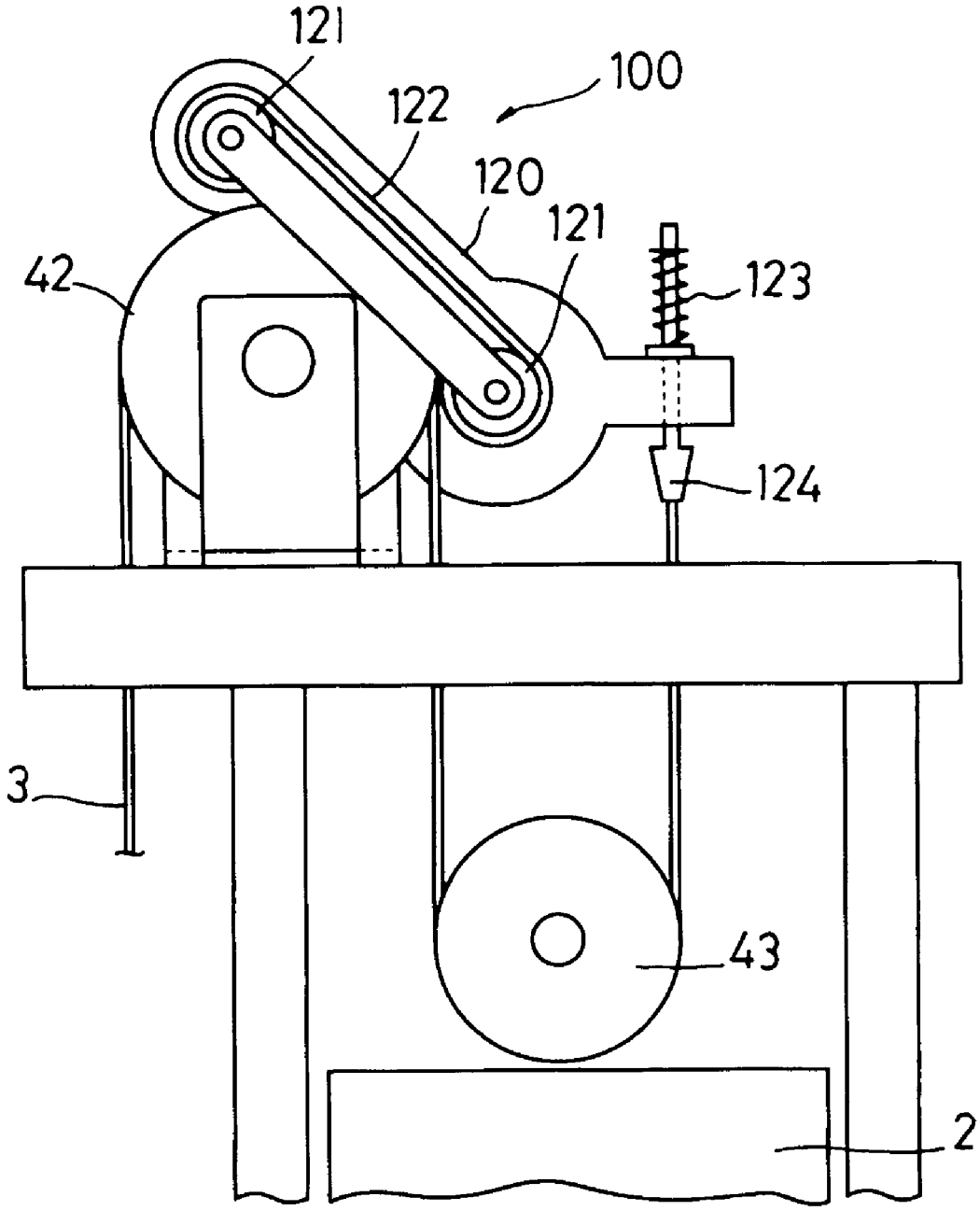
FIG. 19 is a front view of another drive device of the circular-arc drive type.

Like the drive device shown in FIG. 18, a drive device 100 shown in FIG. 19 comprises a belt 122 reeved around two rollers 121, 121. The two rollers 121, 121 are rotatably supported by a frame 120, which is supported so as to be movable toward or away from a sheave 42. The frame 120 has a free end carrying a rope socket 124 thereon, with a compression spring 123 acting therebetween. Joined to the rope socket 124 is one end of a rope 3 extending around a sheave 43 for a counterweight 2.

Accordingly, the tension of the rope 3 acts on the frame 120 of the drive device 100, driving the two rollers 121, 121 toward the sheave 42. With this movement, the belt 122 is strongly pressed into contact with a circular-arc region of the rope 3 as reeved around the sheave 42, thereby giving sufficiently great tension to the belt 122. As a result, a great frictional force is produced between the belt 122 and the rope 3, driving the rope 3 without causing slippage between the rope and the belt 122.

Figure 20:
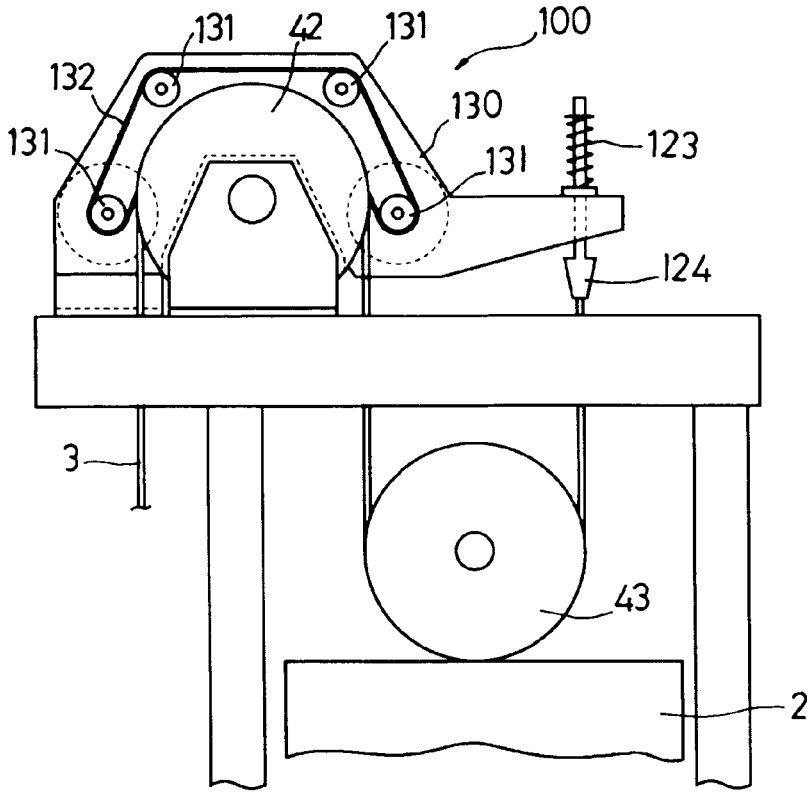
FIG. 20 is a front view of another drive device of the circular-arc drive type.

Like the drive device shown in FIG. 15, a drive device 100 shown in FIG. 20 comprises a belt 132 extending around four rollers 131, 131, 131, 131. These rollers 131, 131, 131, 131 are rotatably supported on a frame 130, which is supported so as to be movable toward or away from a sheave 42. The frame 130 has a free end, to which a rope socket 124 is attached, with a compression spring 123 acting therebetween. Joined to the rope socket 124 is one end of a rope 3 extending around a sheave 43 for a counterweight 2.

Accordingly, the tension of the rope 3 acts on the frame 130 of the drive device 100, driving the four rollers 131, 131, 131, 131 toward the sheave 42. With this movement, the belt 132 is strongly pressed into contact with a circular-arc region of the rope 3 as reeved around the sheave 42, thereby giving sufficiently great tension to the belt 132. As a result, a great frictional force is produced between the belt 132 and the rope 3, driving the rope 3 without causing slippage between the rope and the belt 132.

Figure 21:
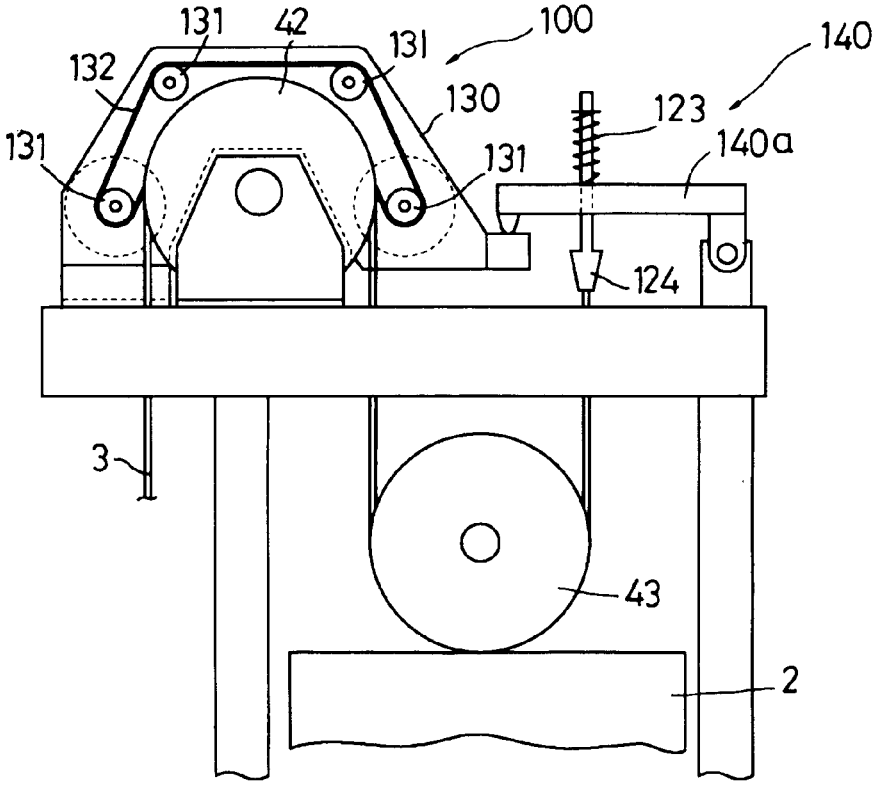
FIG. 21 is a front view of another drive device of the circular-arc drive type.

FIG. 21 shows a drive device 100 corresponding to the drive device shown in FIG. 20, in which a lever mechanism 140 is interposed between the free end of the frame 130 of the device and one end of the rope 3. The lever mechanism 140 has an arm portion 140*a* carrying a rope socket 124, with a compression spring 123 acting therebetween. One end of the rope 3 is joined to the rope socket 124.

The lever mechanism 140 converts the tension of the rope 3 to a force for driving the frame 130, with the portion of the lever mechanism 140 connected to the end of the rope 3 serving as a fulcrum and with the portion thereof opposed to the free end of the frame 130 serving as the point of application. In this way, the tension to be given to the belt 132 is adjusted to a suitable magnitude.

Figure 22:
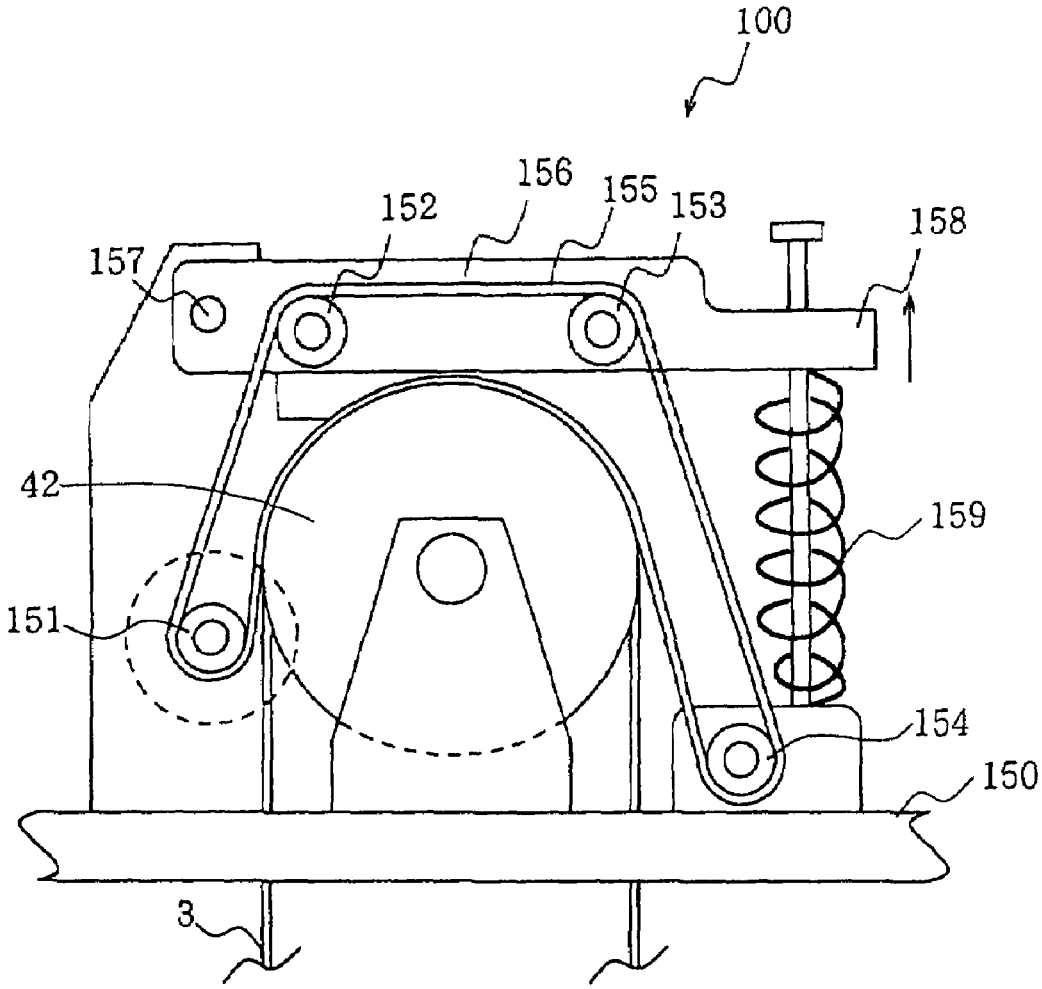
FIG. 22 is a front view of another drive device of the circular-arc drive type.

FIG. 22 shows a drive device 100, wherein a pivotal arm 156 is disposed above a sheave 42. The pivotal arm 156 has a base end supported by a pivot 157 positioned at a specified level on a beam 150, and a forward end 158 of the pivotal arm 156 biased upward by a spring 159. Four rollers 151, 152, 153, 154 are provided with a belt 155 reeved therearound and positioned around the sheave 42. Among these rollers, the two rollers 151, 154 at opposite sides are rotatably supported by the beam 150 and positioned each at a specified level, and the two inward rollers 152, 153 are rotatably supported by the pivotal arm 156. With this drive device 100, the pivotal arm 156 is biased counterclockwise by the spring 159, whereby the inward two rollers 152, 153 are pushed up to tension the belt 155.

Figure 23:
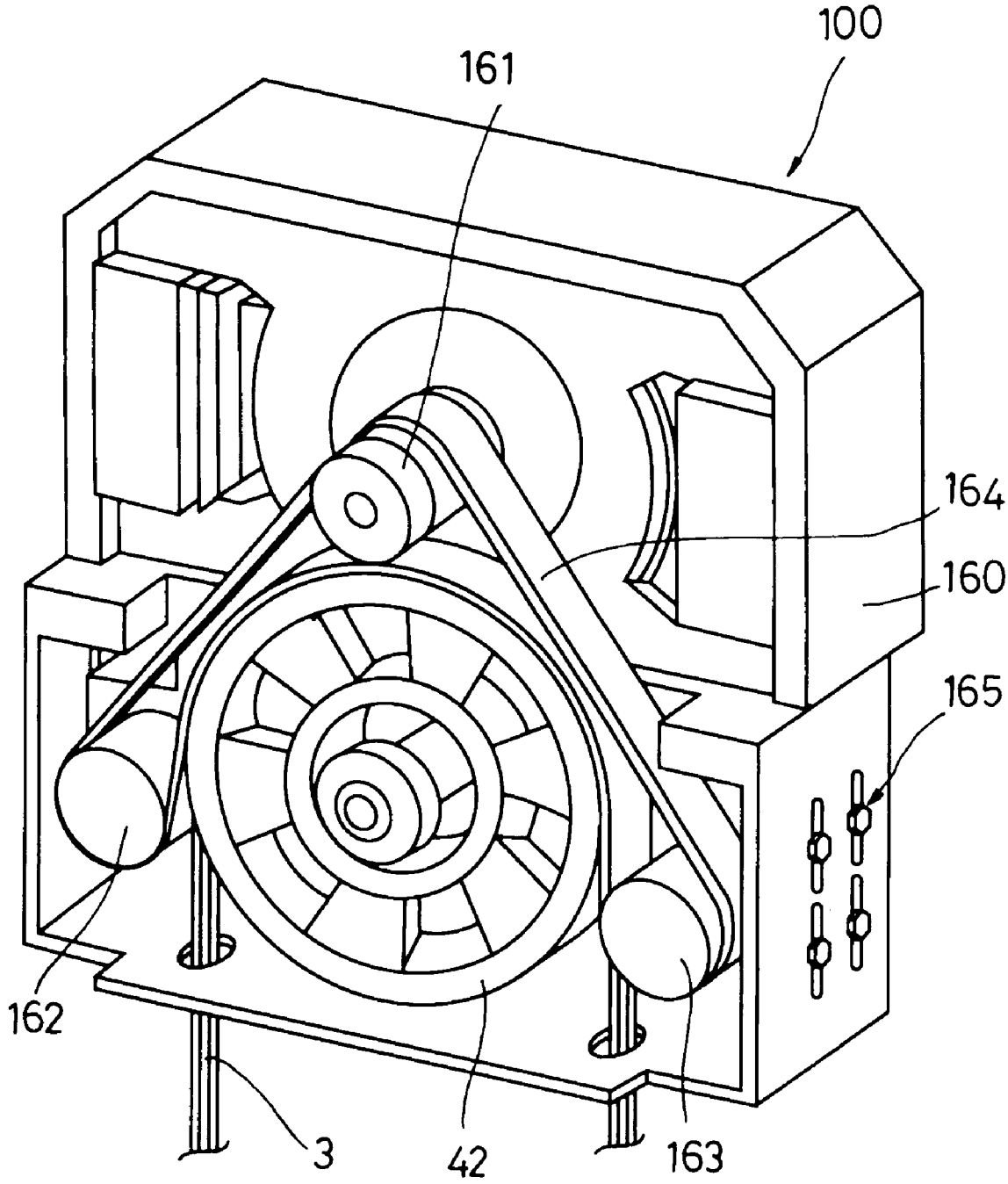
FIG. 23 is a perspective view of another drive device of the circular-arc drive type.
Figure 24:
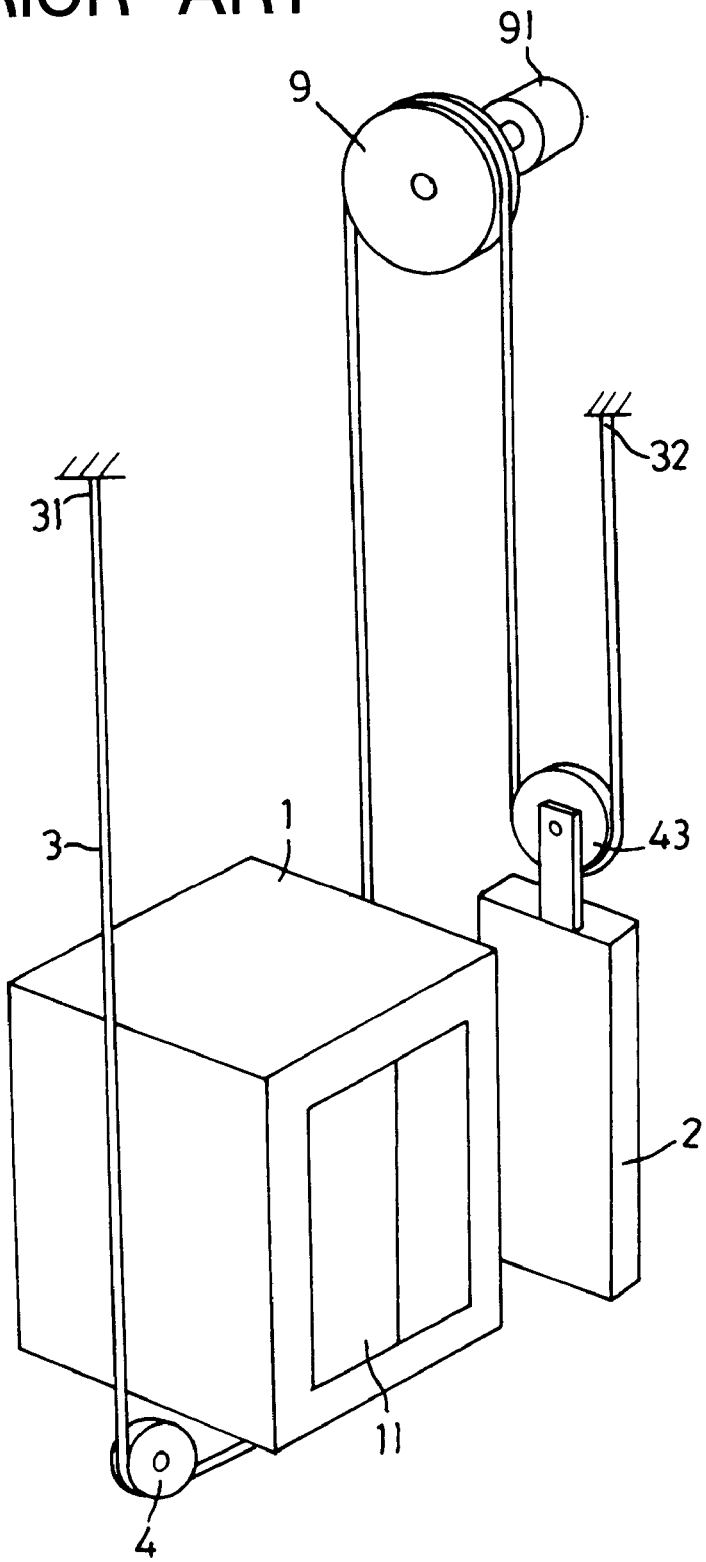
FIG. 24 PRIOR ART
FIG. 24 is a perspective view of a conventional elevator apparatus.
Figure 25:
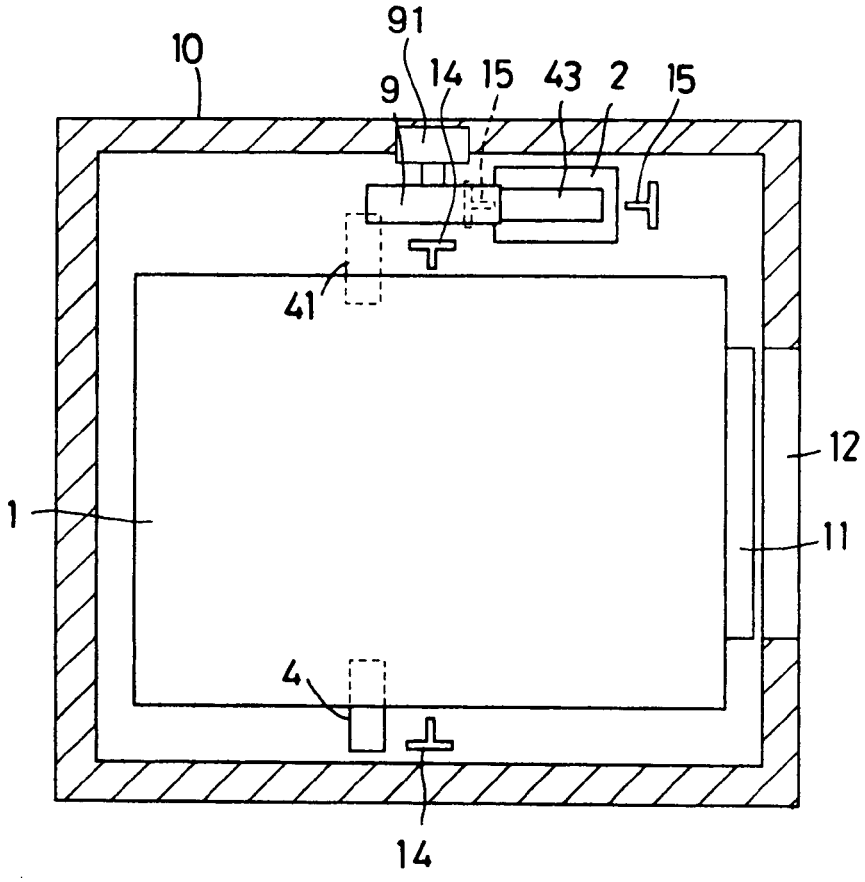
FIG. 25 PRIOR ART
FIG. 25 is a plan view showing an arrangement inside a path of movement of the conventional elevator apparatus.
Figure 26:
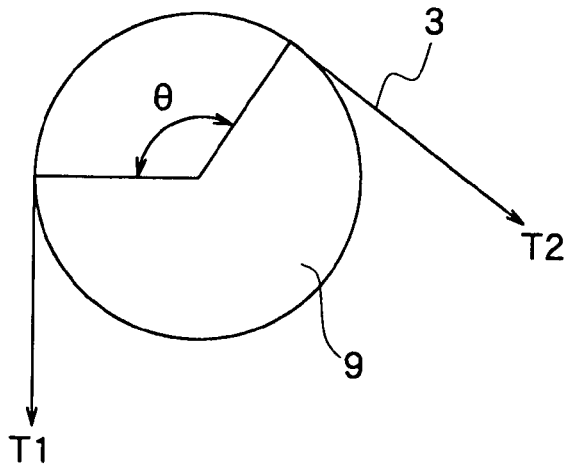
FIG. 26 is a diagram for illustrating forces acting on a rope reeved around a traction sheave.

FIG. 23 shows another drive device 100, wherein a sheave 42 is attached to a frame 160, and rollers 161, 162, 163 are arranged respectively at three locations, i.e., above and at opposite sides of the sheave 42. A belt 164 is reeved around these rollers 161, 162, 163 for pressing ropes 3 as reeved around the sheave 42 against the sheave 42 by the belt 164. Coupled to the upper roller 161 is a motor (not shown) mounted on the rear side of the frame 160. The rollers 162, 163 at opposite sides are each mounted so as to be adjustable in level by a position adjusting mechanism 165. The tension of the belt 164 is adjustable by varying the level.

The elevator apparatus incorporating the drive device of the circular-arc drive type has the same advantages as the drive device of the straight drive type, and can be simpler than the latter in the construction of the drive device. Since a belt is pressed against the circular-arc region of a rope as reeved around a sheave of large diameter, it is possible to reduce the magnitude and variation rate of specific pressure acting between the belt and the rope. When theoretically calculated, the maximum value of specific pressure of each of the rope surface and the belt surface is about 4 MPa in the case of the straight drive type, and the maximum values of specific pressures of the rope surface and the belt surface are smaller and are respectively about 2 MPa and about 1 MPa in the case of the circular-arc drive type. This serves to preclude the damage to be caused to the belt and the rope to ensure a prolonged life.

Furthermore, the drive device of the circular-arc drive type, which is simpler in construction than the device of the straight drive type, is diminished in mechanical losses, therefore permitting use of a motor of smaller capacity and achieving a reduction in power consumption. When theoretically calculated, the power transmission efficiency of the drive device of the straight drive type is about 70%, and that of the drive device of the circular-arc drive type is as high as about 95%.

Furthermore, the belt constituting the drive device of the circular-arc drive type is pressed against the circular-arc region of the rope by virtue of the tension thereof. The belt can therefore be smaller in thickness than when the belt is pressed by pressing rollers of small diameter as is the case with the drive device of the straight drive type. Thus, the rollers for driving the belt can be reduced in diameter and the drive motor to be used can be of smaller capacity. The noise to be produced by the drive device of the circular-arc drive type is much smaller, while the device can be maintained satisfactorily.

The mechanism or apparatus of the present invention is not limited to the foregoing embodiments in construction but can be modified variously within the technical scope defined in the appended claims. For example, the belt to be brought into frictional contact with the rope for driving need not always have a recessed curved contact face which is circular-arc in cross section, but a grooved surface of V-shaped cross section or one of various other cross sections is similarly useful. On the other hand, it is effective that the belt surface to be in contact with the roller be mirror-finished so as to ensure an improved degree of intimate contact with the roller. The belt for driving the rope by frictional contact therewith can be composed of a plurality of belt pieces divided in a direction orthogonal to the longitudinal direction of the rope 3 so as to use each of the belt pieces in contact with one or a plurality of ropes 3.

A core having high tension and high strength can be incorporated in the belt for driving the rope by frictional contact therewith, and the belt surface layer to be in contact with the rope can be made from a material having abrasion resistance. A belt of multilayer structure is useful which comprises, for example, a layer of chloroprene rubber, a layer of polyamide woven fabric and a layer of aramid cord. If the materials to be used for the rope and the belt have the same modulus of longitudinal elasticity (spring constant), diminished slippage will result between the two members. The advantage of suppressed wear is then available.

A tension member in the form of a belt can be used in place of the rope 3 serving as a tension member. Use of a belt having the same structure as described above especially leads to the same modulus of longitudinal elasticity (spring constant) between the belts to be in contact with each other, and to the advantage of reduced slippage and suppressed wear.

The motor for driving the belt need not always be coupled to the center shaft of the roller as shown in FIG. 2 or 15, but can be housed in the roller for driving the roller from inside. The drive device of only one type, i.e., the drive device 5 of the straight drive type or the drive device 100 of the circular-arc drive type, can be installed at each of a plurality of locations, or devices of the both types can be used in combination.

The reciprocatingly movable body drive mechanism of the invention is not limited only for use in elevator apparatus of the type movable upward or downward wherein a cage and a counterweight are arranged at opposite sides as described above, but can be used also in elevator apparatus of the horizontally movable type, elevator apparatus wherein cages are arranged respectively on opposite sides, cable railways, ropeways, etc.

The invention claimed is:

1. A reciprocatingly movable body drive mechanism comprising a tension member in the form of a rope or belt for reciprocatingly driving a reciprocatingly movable body, and a drive device for driving the tension member longitudinally thereof while pressing a specified region of the tension member sideways in contact with the tension member, the tension member being reeved around at least one sheave, and the drive device being in contact with a circular-arc region of the tension member as reeved around the sheave for pressing the circular-arc region against the sheave, wherein the drive device comprises a belt transmission disposed alongside the tension member and revolvingly movable alone a tension member extension route, a pressing mechanism for pressing a belt surface of the belt transmission into contact with the tension member, and a drive motor for driving the belt transmission.

2. An elevator apparatus comprising a reciprocatingly movable body reciprocatingly movably provided in a path of reciprocating movement, and a mechanism for reciprocatingly driving the body, the elevator apparatus being characterized in that the reciprocatingly driving mechanism comprises:

a sheave disposed at a predetermined level, a tension member in the form of a rope or belt and extending along a path around the sheave, and a drive device for driving the tension member in engagement therewith by pressing a specified longitudinal region of the tension member sideways, and the drive device is provided for the tension member as reeved around at least one sheave disposed along the tension member extension route to press a circular-arc region of the tension member against the sheave, wherein the drive device comprises a belt revolvingly movable while being pressed against the circular-arc region of the tension member, a plurality of rollers arranged alone a path of revolving movement of the belt, and a drive motor for rotatingly driving at least one of the rollers.

3. An elevator apparatus according to claim 2 wherein the belt has a grooved portion extending longitudinally of the tension member and in contact with the tension member.

4. An elevator apparatus according to claim 2 wherein the belt comprises a plurality of belt pieces arranged side by side in a direction orthogonal to the longitudinal direction of the tension member, and each of the belt pieces is in contact with one or a plurality of tension members.

5. An elevator apparatus according to claim 2 wherein the belt has incorporated therein a core having high tension and high strength.

6. An elevator apparatus according to claim 2 wherein the belt has a multilayer structure, and a surface layer in contact with the tension member and made of a material having abrasion resistance.

7. An elevator apparatus according to claim 2 wherein the drive device comprises a mechanism for tensioning the belt.

8. An elevator apparatus according to claim 7 wherein the tensioning mechanism comprises a frame supported so as to be movable toward or away from the sheave, the plurality of rollers being rotatably supported by the frame, and the tension member has one end connected to a free end of the frame.

9. An elevator apparatus according to claim 2 wherein the drive device is provided inside the path of reciprocating movement.

10. An elevator apparatus according to claim 2 wherein the drive device is disposed at each of a plurality of locations along the tension member extension route.

* * * * *

UNITED STATES PATENT AND TRADEMARK OFFICE

CERTIFICATE OF CORRECTION

PATENT NO. : 7,178,637 B2
APPLICATION NO. : 10/467161
DATED : February 20, 2007
INVENTOR(S) : Asano et al.

It is certified that error appears in the above-identified patent and that said Letters Patent is hereby corrected as shown below:

On the Cover Page;
in item 54 change, "BOTH-WAY MOVABLE BODY DRIVING MECHANISM AND ELEVATOR USING THE SAME" to be -- RECIPROCATINGLY MOVABLE BODY DRIVE MECHANISM AND ELEVATOR APPARATUS INCORPORATING SAME --

In Column 1;
on lines 1 thru 3 change, "BOTH-WAY MOVABLE BODY DRIVING MECHANISM AND ELEVATOR USNG THE SAME" to be
-- RECIPROCATINGLY MOVABLE BODY DRIVE MECHANISM AND ELEVATOR APPARATUS INCORPORATING SAME --

In Column 13;
on line 28 change, "movable alone a" to be -- movable along a --

In Column 14;
on line 8 change, "arranged alone a'" to be -- arranged along a --

Signed and Sealed this

Tenth Day of July, 2007

JON W. DUDAS
*Director of the United States Patent and Trademark Office*